US005570736A

United States Patent [19]

Nara et al.

[11] Patent Number: 5,570,736

[45] Date of Patent: Nov. 5, 1996

[54] PROCESS OF CONTINUOUSLY CASTING STEEL USING ELECTROMAGNETIC FIELD

[75] Inventors: Seikou Nara; Hisao Yamazaki; Nagayasu Bessho; Seiji Taguchi; Tetsuya Fujii, all of Chiba, Japan

[73] Assignee: Kawasaki Steel Corporation, Kobe, Japan

[21] Appl. No.: 64,084

[22] PCT Filed: Sep. 25, 1992

[86] PCT No.: PCT/JP92/01221

§ 371 Date: May 19, 1993

§ 102(e) Date: May 19, 1993

[87] PCT Pub. No.: WO93/05907

PCT Pub. Date: Jan. 4, 1993

[30] Foreign Application Priority Data

| | | | |
|---|---|---|---|
| Sep. 25, 1991 | [JP] | Japan | 3-246074 |
| Sep. 25, 1991 | [JP] | Japan | 3-246077 |
| Sep. 25, 1991 | [JP] | Japan | 3-246079 |
| Oct. 4, 1991 | [JP] | Japan | 3-257309 |
| Oct. 4, 1991 | [JP] | Japan | 3-257312 |
| Mar. 6, 1992 | [JP] | Japan | 4-049177 |
| Apr. 22, 1992 | [JP] | Japan | 4-127938 |

[51] Int. Cl.[6] ..... B22D 11/00

[52] U.S. Cl. ..... 164/466; 164/498; 164/502

[58] Field of Search ..... 164/498, 499, 164/48, 466, 468, 502, 504

[56] References Cited

U.S. PATENT DOCUMENTS

| | | | |
|---|---|---|---|
| 5,095,969 | 3/1992 | Soejima | 164/468 |
| 5,265,665 | 11/1993 | Fujii | 164/466 |
| 5,381,857 | 1/1995 | Tozawa | 164/466 |

FOREIGN PATENT DOCUMENTS

| | | | |
|---|---|---|---|
| 0401504 | 12/1990 | European Pat. Off. | 164/466 |
| 57-127556 | 8/1982 | Japan | 164/468 |
| 58-55157 | 1/1983 | Japan . | |
| 611459 | 1/1986 | Japan . | |
| 61-1459 | 7/1986 | Japan . | |
| 61-193754 | 8/1986 | Japan | 164/468 |
| 62-3857 | 1/1987 | Japan . | |
| 62-130752 | 6/1987 | Japan | 164/466 |
| 63-260652 | 10/1988 | Japan | 164/468 |
| 3142049 | 6/1991 | Japan . | |
| 1371764 | 2/1988 | U.S.S.R. | 164/468 |

*Primary Examiner*—Joseph J. Hail, III
*Assistant Examiner*—James Miner
*Attorney, Agent, or Firm*—Dvorak and Traub

[57] ABSTRACT

A process for continuously casting steel slabs employing a molten steel containing an oxygen concentration of 30 ppm or less, preferably, 20 ppm or less, using a straight immersion nozzle to which an inert gas is not injected, and disposing a static magnetic field generator on the back surface of the mold for applying the strong static magnetic field to the molten steel within the mold, thereby restricting the flow of the molten steel. With this process, it is possible to prevent the nozzle blocking, and hence to obtain the steel slabs excellent in the internal and surface qualities.

9 Claims, 28 Drawing Sheets

PROCESS OF CONTINUOUSLY CASTING STEEL USING ELECTROMAGNETIC FIELD

TECHNICAL FIELD

The present invention relates to a process of continuously casting steel slabs for further improving the surface and internal qualities of the steel slabs obtained by continuous casting.

BACKGROUND ART

In a process of continuously casting semi-finished products such as steel slabs used for manufacture of the broaden steel plates, a refractory material made immersion nozzle is commonly used for a molten steel path between a tundish containing molten steel and a continuous casting mold. The immersion nozzle is disadvantageous in that, since alumina is liable to be deposited on the inner surface of the nozzle, particularly, in continuous casting for aluminum-killed steels, the molten steel path is narrowed with casting time, which makes it impossible to obtain the desired flow rate of the molten steel.

In general, to prevent the deposition of alumina, an inert gas such an Ar gas is supplied within the nozzle during supplying the molten steel. However, when the discharge speed of the molten steel is larger in high speed casting with high throughput, the inert gas is trapped in the flow of the molten steel and is obstructed from being floated on the molten pool surface within the mold, to be thus trapped in the solidified shell. Because of the inert gas trapped in the steel, there often occur defects such as sliver, blistering and the like in the final products.

Also, in an immersion nozzle of a two-hole type, which includes the right and left symmetric discharge ports at the lower end portion thereof, the flow of the molten steel in the mold is liable to be made uneven by the asymmetric blocking caused in the right and left discharge ports, thereby bringing about the lowering of the quality of the product. In this case, differently from the gas trap, there occur the entrapments of inclusions and mold powder due to a deflected flow generated by the blocking of the discharge ports of the nozzle.

The present inventors have examined the nozzle blocking in continuous casting using a low carbon aluminum-killed steel being mainly deoxidized by Al and containing a carbon concentration of 500 ppm or less. As a result, it was found that the nozzle blocking was almost eliminated by adjusting the oxygen concentration in molten steel to be 30 ppm or less, preferably, 20 ppm or less, and using a pipe-like straight immersion nozzle with the leading edge being opened and served as the discharge port for molten steel. However, such a straight nozzle is disadvantageous in that, since the discharge flow of the molten steel is directed downwardly of the mold, the inclusions and gas babbles in molten steel permeate to the deep portion of the molten steel pool.

To prevent the permeation of the inclusions and the like, there has been proposed such a technique that a static magnetic field generator for applying a static magnetic field to the molten steel is disposed around the continuous casting mold for restricting the flow of the molten steel being directed downwardly. For example, Japanese Patent Laid-open sho 58- 55157 discloses a technique of generating a direct current magnetic field in the level near the meniscus around a continuous casting mold, and of adjusting the intensity and direction thereof, thereby controlling the permeation depth and the permeation direction of the pouring flow of the molten steel. However, in this technique, the magnetic field is applied only to the level near the meniscus, and accordingly, the restricting force is insufficient.

The present inventors have established a technique of casting steel slabs excellent in qualities, which comprises the step of adjusting the oxygen concentration in molten steel at a lower value, and using a straight nozzle without injection of Ar gas within the nozzle, thereby preventing the nozzle blocking, while controlling the descending flow of the molten steel by the strong restricting force.

Further, the present inventors have found the following fact: namely, for the meniscus variation which is attributed to the flow of the molten steel toward the meniscus generated by the effect of restricting the descending flow of the molten steel, it is effectively restricted by applying the static magnetic field to the meniscus portion.

A primary object of the present invention is to provide a process of continuously casting steel slabs capable of obtaining the steel slabs excellent in the surface and the internal qualities.

Another object of the present invention is to eliminate the nozzle blocking in continuous casting without using Ar gas.

A further object of the present invention is to provide a technique of continuously casting the steel slabs, which comprises the steps of applying a suitable restricting force to the descending flow of the molten steel, and preventing the meniscus variation caused by the above application.

DISCLOSURE OF THE INVENTION

To achieve the above objects, the present invention has been made on the basis of the above knowledge, and the technical means are as follows: namely, in the present invention, the molten steel containing an oxygen concentration of 30 ppm or less is supplied to a continuous casting mold from a tundish using a straight immersion nozzle to which an inert gas is not injected, and the magnetic field is applied to the mold under the limited condition.

The limitation preferably lies in disposing a static magnetic field generator on the back surfaces of the long side walls of the mold at the height including the level of the discharge port of the straight immersion nozzle; and casting the molten steel while generating a static magnetic field directing from one long side wall to the other long side wall of the mold, wherein according to a discharge flow velocity <v> (m/sec) [flow rate of molten steel ($m^3$/sec)/nozzle sectional area ($m^2$)] from the discharge port of the straight immersion nozzle, a relationship between a magnetic flux density B (T) and an applied magnetic field height range L (mm) vertically under the discharge port of the straight immersion nozzle is set as follows:

$v \leqq 0.9$ (m/sec), $B \times L \geqq 25$,
where $B \geqq 0.07T$, $L \geqq 80$ mm $v \leqq 1.5$ (m/sec), $B \times L \geqq 27$,
where $B \geqq 0.08T$, $L \geqq 90$ mm $v \leqq 2.0$ (m/sec), $B \times L \geqq 30$,
where $B \geqq 0.09T$, $L \geqq 100$ mm $v \leqq 2.5$ (m/sec), $B \times L \geqq 33$,
where $B \geqq 0.09T$, $L \geqq 110$ mm $v \leqq 3.0$ (m/see), $B \times L \geqq 35$,
where $B \geqq 0.1T$, $L \geqq 110$ mm $v \leqq 3.8$ (m/sec), $B \times L \geqq 36$,
where $B \geqq 0.11T$, $L \geqq 120$ mm $v \leqq 4.8$ (m/sec), $B \times L \geqq 38$,
where $B \leqq 0.12T$, $L \geqq 120$ mm $v \leqq 5.5$ (m/sec), $B \times L \geqq 40$,
where $B \geqq 0.13T$, $L \geqq 130$ mm Also, the limitation preferably lies in disposing a static magnetic field generator on the back surfaces of the long side walls of the mold at the height including the level of the discharge port of the straight immersion nozzle; disposing a gap portion, and further disposing at least one or more stages of static magnetic field generators on the lower side than the gap portion; and casting the molten steel while generating the static magnetic field directing from one long side wall to the other long side wall of the mold.

Further, the limitation preferably lies in disposing a static magnetic field generator on the back surfaces of the long side walls of the mold at the position higher than the level of the discharge port of the straight immersion nozzle; disposing a gap portion, and further disposing at least one or more stages of static magnetic field generators on the lower portion of the mold; and casting the molten steel while generating the static magnetic field directing from one long side wall to the other long side wall of the mold.

Still further, the limitation preferably lies in applying a static magnetic field in the direction perpendicular to the long side surface of the casting only to the vicinity of the widthwise central portion of the casting from the back surfaces of the long side walls of the mold positioned at the height lower than the level of the discharge port of the straight immersion nozzle; and applying a direct current in the direction perpendicular to the short side surface of the casting.

Additionally, the limitation preferably lies in disposing a static magnetic field generator on the back surfaces of the long side walls of the mold at the position including the level of the discharge port of the straight immersion nozzle; and casting the molten steel while generating the static magnetic field from one long side wall to the other long wall of the mold, and applying a direct current to the vicinity of the discharge port of the straight immersion nozzle in the direction perpendicular to the short side surface of the casting.

BEST MODE FOR CARRYING OUT THE INVENTION

There is known the technique of disposing an electromagnet around a mold of a slub continuous casting machine, and applying a static magnetic field to molten steel in the mold, thereby controlling the flow of the molten steel by a Lorentz force caused by the mutual action between the current induced in the molten steel and the magnetic field. In this technique, however, to prevent the flow of the molten steel discharged from the immersion nozzle from permeating in the deep portion of the molten steel pool, it is insufficient to apply the static magnetic field only in the vicinity of the meniscus.

Figure 1A:
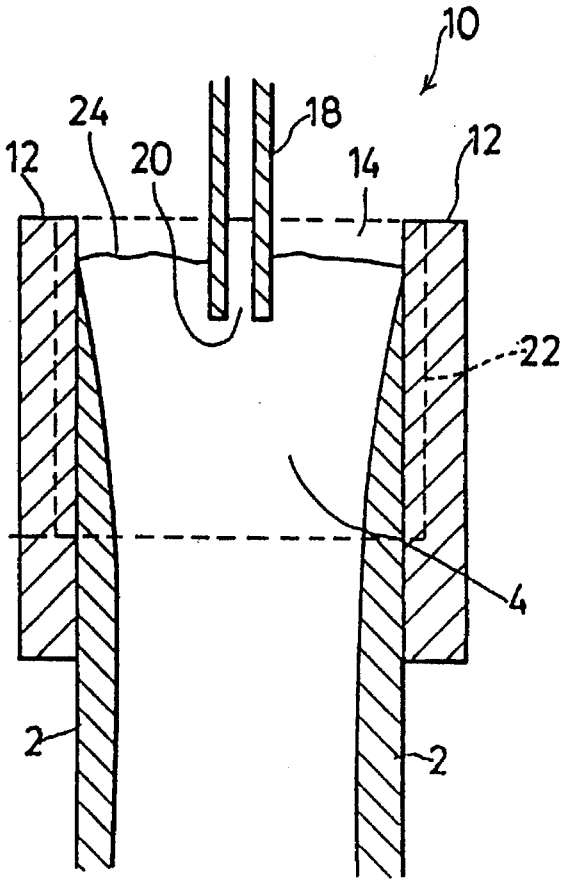
FIGS. 1(*a*) and 1(*b*) are schematic sectional views showing a main portion of a continuous casting apparatus including a one-stage static magnetic field generator used in Working example 1.
Figure 1B:
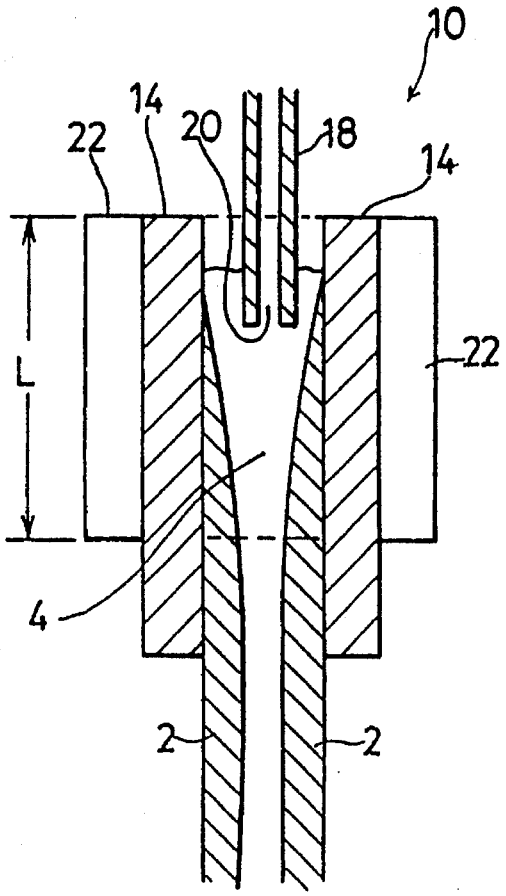

FIGS. 1(*a*) and 1(*b*) show the construction of the main portion of a continuous casting apparatus suitable for carrying out an embodiment of the present invention. A straight immersion nozzle 18 is suspended from a tundish into a continuous casting mold 10 constituted of a pair of short side walls 12, 12 and a pair of long side walls 14, 14. The straight immersion nozzle 18 has a pipe structure with a discharge port 20 straightly opened at its lower end portion.

A static magnetic field generator 22 is disposed around the back surfaces of the long side walls 14 and 14 of the continuous casting mold 10 at the height including the vicinity of the discharge port 20 of the straight immersion nozzle 18 and a meniscus 24, and which generates a static magnetic field in parallel to the short side walls 12 and 12 across the long side walls 14 and 14. The static magnetic field thus generated functions to decelerate the molten steel discharged from the straight immersion nozzle 18 and simultaneously suppress the variation of the meniscus 24, thereby preventing the entrapment of mold power in the molten steel.

Figure 2:
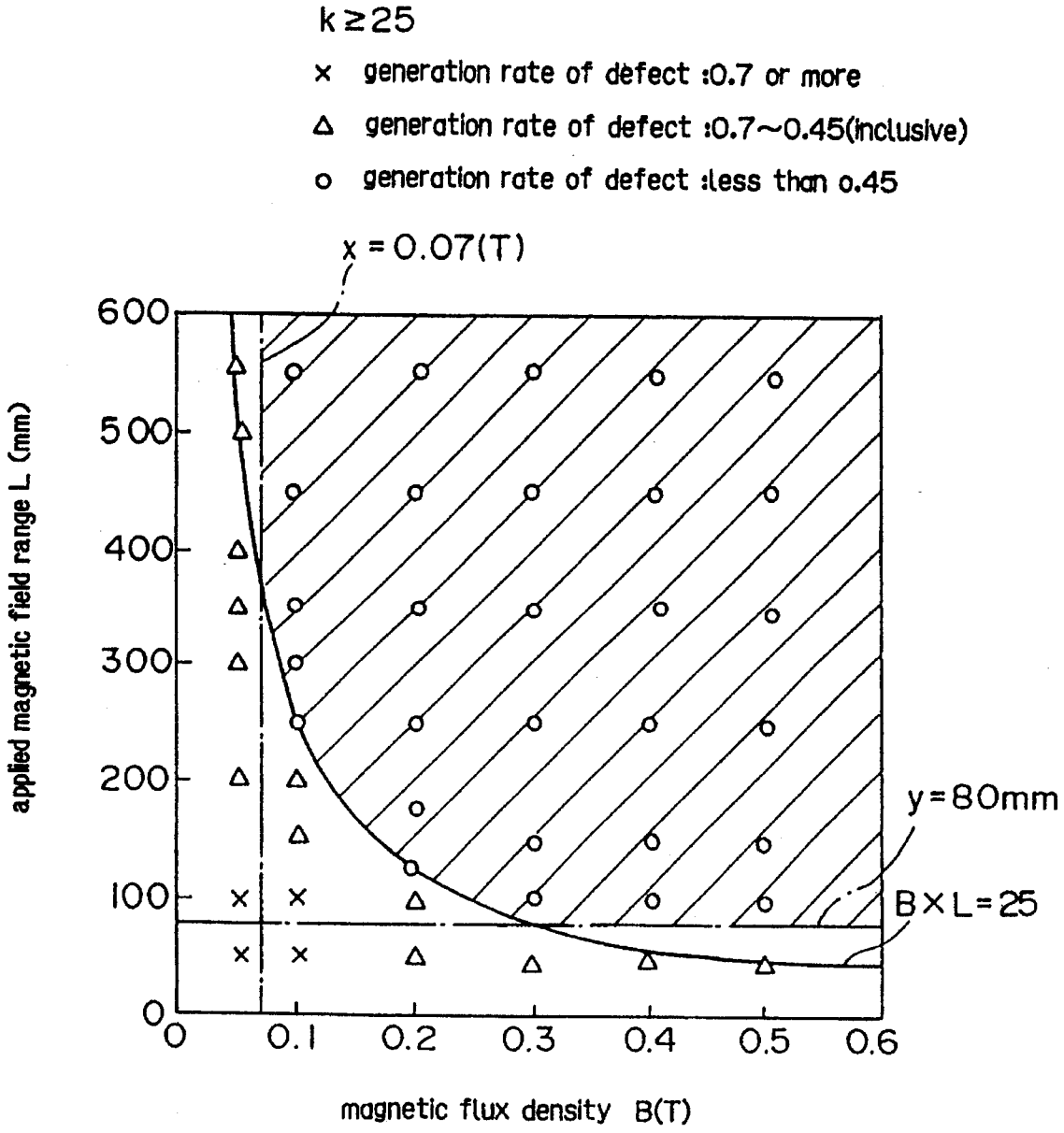
FIG. 2 is a graph showing the generation rate of defects in the case of using the one-stage static magnetic field generator in Working example 1.

Using the mold 10, by changing the discharge velocity <v> of the molten steel from the straight nozzle depending on the throughput, and further, by changing the applied magnetic field intensity B and the applied magnetic field range L (dimension in the height direction), the defects generated in the cold-rolled materials were observed. FIG. 2 shows the generation rate of defects effected by changing the discharge flow rate <v>, the applied magnetic field range L (mm) and the magnetic flux density B (T). With respect to the cold-rolled materials obtained by changing the magnetic-field flux and the applied magnetic field range, the generation rates of defects examined by magnetic inspection are indicated as circular marks (less than 0.45), triangular marks (0.45–0.7), and X marks (0.7 or more), with the generation rate of defects in the no magnetic field casting being taken as 1.

As shown in FIG. 2, as compared with no magnetic field casting, according to the present invention, the generation rate of defects becomes 0.045 or less in a region where the factor k =B·L obtained by the magnetic flux density B (X-axis) and the applied magnetic field range L (y-axis) is 25 or more, the applied distance L is 80 mm or more, and the magnetic flux density B is 0.07T or more.

Figure 9B:
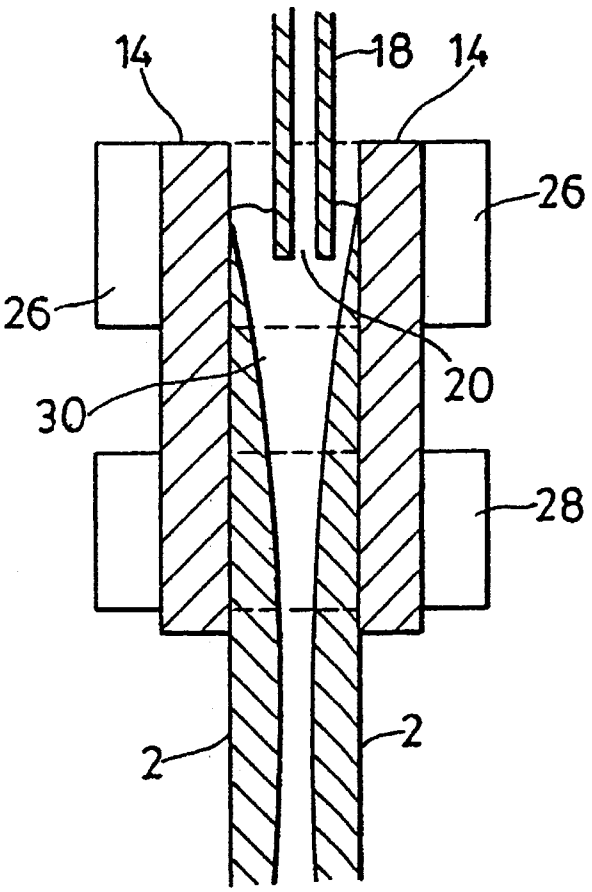
FIGS. 9(*a*) and 9(*b*) are schematic sectional views showing the construction of the main portion or a continuous casting apparatus including two-stage static magnetic generator used in Working example 6.
Figure 9A:
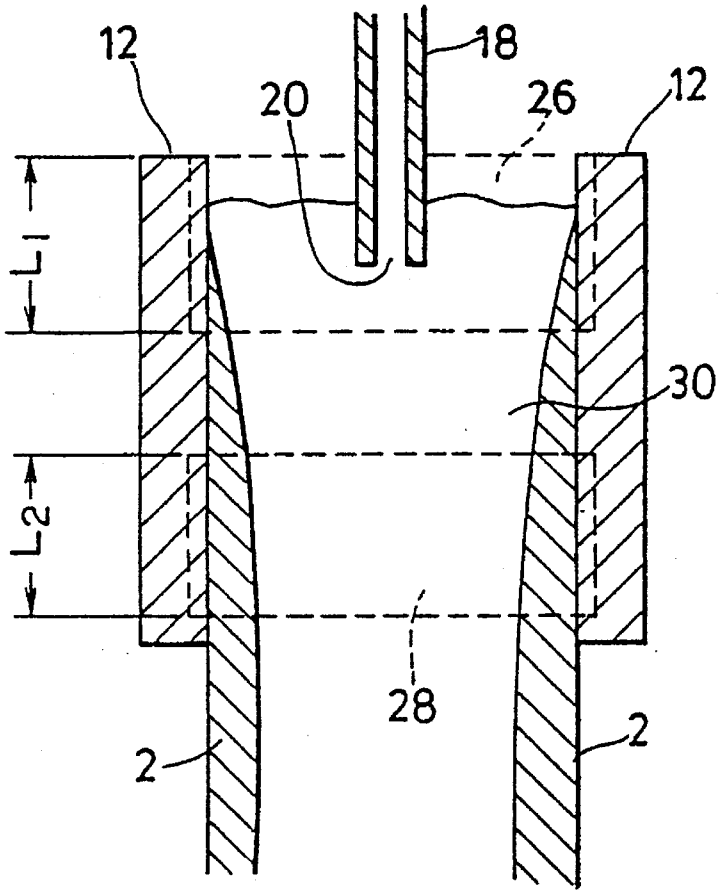

Next, there will be described the construction as shown in FIG. 9. In this figure, a straight immersion nozzle 18 is used and also static magnetic field generators 26 and 28 are disposed in the upper and lower sides. Between the upper and lower static magnetic field generators 26 and 28, a gap portion 30 being almost in no magnetic field state is provided for equalizing the flow of the decelerated molten steel. With the aid of the presence of the gap portion 30, and the static magnetic field generated by the lower static magnetic field generator 28 to be directed across the long side walls 14 and 14 in parallel to the short side walls 12 and 12, the molten steel decelerated by the static magnetic field generator 26 is descended while advancing toward the short side wall 12. As a result, it is possible to obtain the sufficiently decelerated and equalized descending flow of the molten steel.

Figure 10:
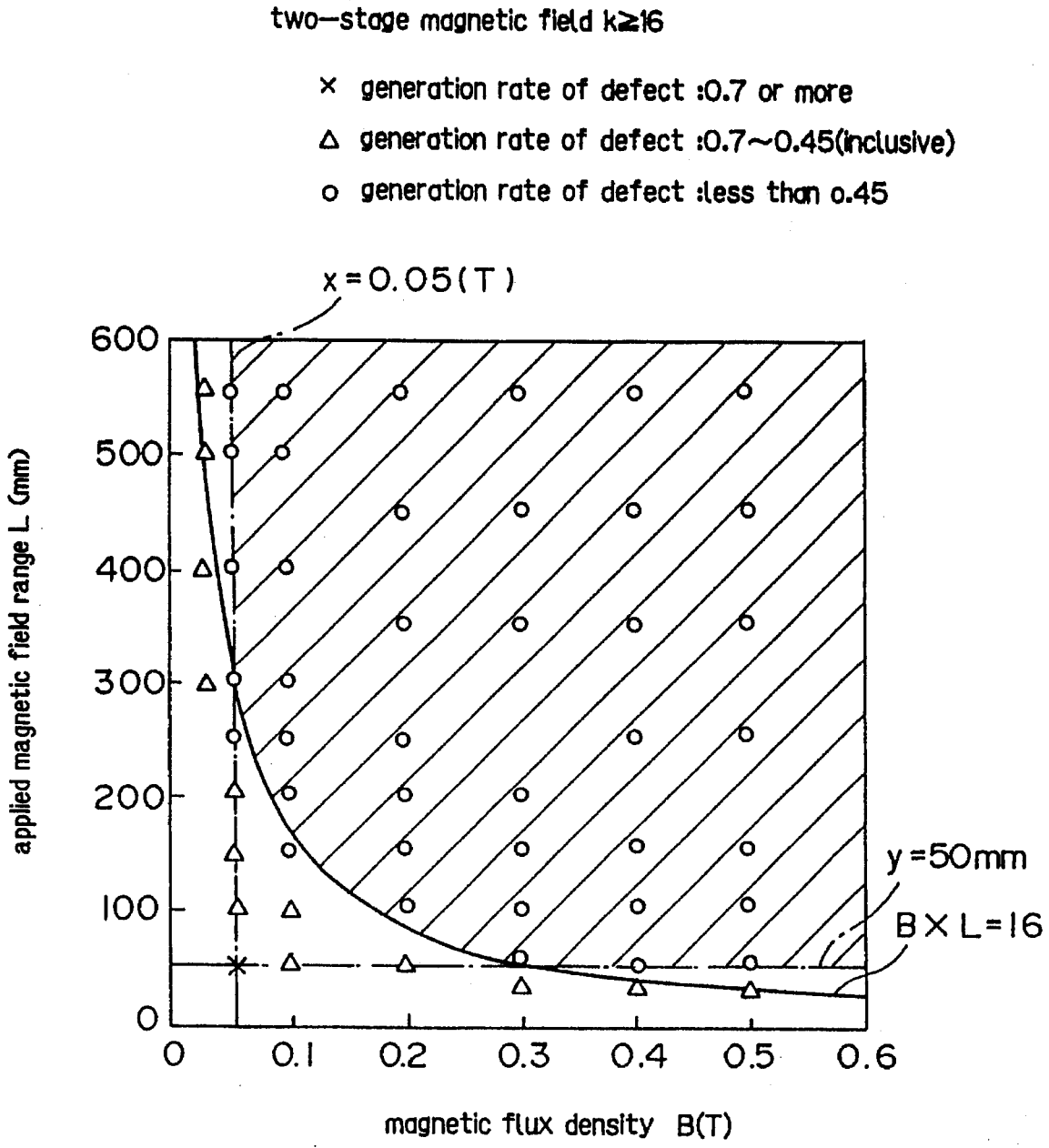
FIG. 10 is a graph showing the generation rate of the defects in the case of using the two-stage static magnetic generator.

FIG. 10 shows the generation rate effected by changing the discharge flow rate <v>, the magnetic flux density B and the applied magnetic field range L. In this figure, as compared with the no magnetic field casting, according to the present invention, the generation rates of defects are indicated as circular marks (less than 0.45), triangular marks (0.45–0.7), and X marks (0.7 or more), with the generation rate of defects in the cold-rolled materials obtained by the no magnetic field casting being taken as 1.

As is apparent from FIG. 10, the generation rate of defects is less than 0.45 in a region where the factor k=B·L obtained by the magnetic flux density B and the applied magnetic field range L is 16 or more. As a result, it becomes apparent that the applied magnetic field range is preferable as compared with the casting with the one-stage static magnetic field. Thus, by applying the two-stage static magnetic field, it is possible to significantly improve the quality even when the applied magnetic field range and the applied magnetic field intensity are small.

The above results show that, by use of the straight immersion nozzle and the static magnetic field, it is possible to achieve the continuous casting without nozzle blocking, and hence to improve the productivity. Further, what is more important, by eliminating the nozzle blocking, it is possible to suppress the deflected flow of the molten steel, and hence to obtain clean slabs. In particular, by specifying the magnetic flux density and the applied magnetic field range, it is possible to obtain the cold-rolled materials remarkably reduced in the generation rate of defects.

Also, by applying the static magnetic field at the position including the molten pool surface within the continuous casting mold, it is possible to suppress the variation of the molten pool surface. Further, by applying the static magnetic field in the vicinity of the discharge port of the immersion nozzle, and further, by providing the gap portion and applying the static magnetic field at the lower side, it is possible to obtain the equalized descending flow of the molten steel. This makes it possible to manufacture the further clean steel slabs without the entrapment of mold powder.

In particular, it is important to generate the static magnetic field in the vicinity of the meniscus in a manner to cover the whole surface of the molten pool. For example, in the case of applying the static magnetic field not to the molten pool surface but only to the lower portion of the molten pool surface, it is possible to restrict the flow under the molten pool surface; however, it is impossible to suppress the oscillation of the molten pool surface. Accordingly, there occurs the entrapment of the mold powder on the molten pool surface due to the oscillation of the molten pool surface.

In addition, although the magnetic field achieves the important role in the present invention, the range of the magnetic field needs to be set in the following: First, the static magnetic field must be applied to the range containing the leading edge portion of the nozzle and the lower portion than the same. In particular, in the case that the discharge port of the nozzle leading edge portion exists within the magnetic field, the discharge flow of the molten steel becomes the moderated descending flow by being sufficiently decelerated by the magnetic field. Next, the decelerated discharge flow becomes further equalized descending flow by the presence of the gap portion and the lower magnetic field, which makes it possible to obtain the castings excellent in the internal and surface qualities.

Further, at the lower portion where the molten steel is jetted from the discharge port of the nozzle, it is preferable to generate the static magnetic field in a manner to wholly cover the continuous casting mold, as compared with the manner to partially generate the static magnetic field.

Figure 23A:
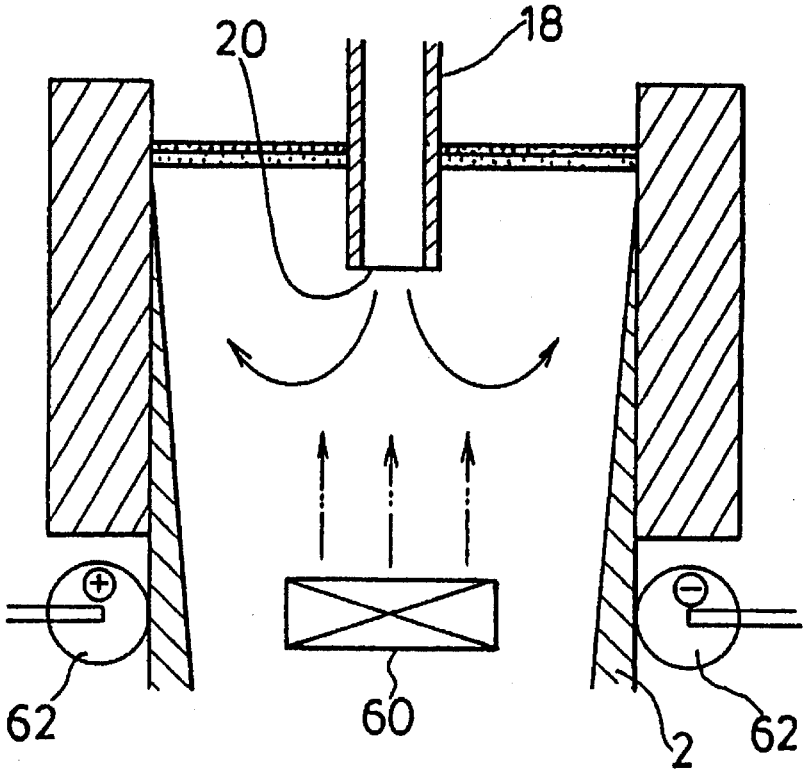
FIGS. 23(*a*) and 23(*b*) are schematic views showing Working example 16.
Figure 23B:
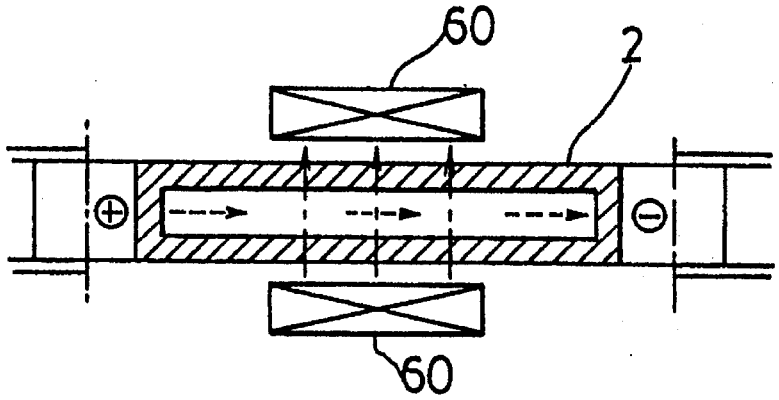

Next, in the present invention, the magnetic field by excitation may be added. FIG. 23 shows such an example, wherein static magnetic field generating coils 60 are provided directly under a mold 10 for generating the static magnetic field in the direction perpendicular to the long side surface of the casting, and exciting rolls 62 for applying a direct current are provided in the direction perpendicular to the short side surface of the casting. The static magnetic field generated by the static magnetic field generating coils 60 are applied only to the widthwise central portion of the casting 2 from the desired point of the lower portion than the discharge port 20 of the immersion nozzle, for example, the position directly under the mold 10. In FIG. 23, the directions of the magnetic field B, the current I and the electromagnetic force F in the molten steel are shown as a chain line, a dashed line, and two-dot chain line, respectively. In this case, by applying the excitation of the static magnetic field at the lower side than the discharge port 20 of the immersion nozzle, it is possible to effectively reduce the descending flow rate within the casting, thereby preventing the permeation of the inclusions and bubbles. In the static magnetic field exciting continuous casting process, since the discharge flow from the nozzle usually becomes the equalized downward flow of the molten steel, the above static magnetic field excitation is applied to restrict the molten steel at the lower position than the discharge port 20 of the immersion nozzle.

Figure 29A:
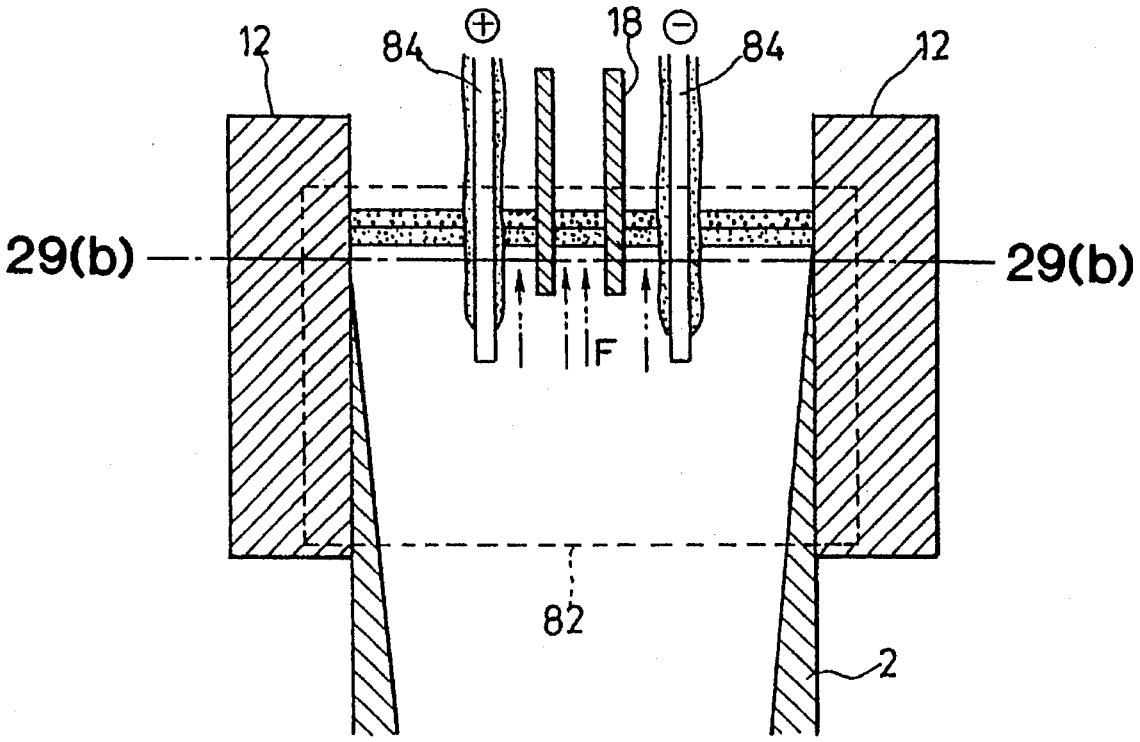
FIGS. 29(*a*) and 29(*b*) are explanatory views of Example 20.
Figure 29B:
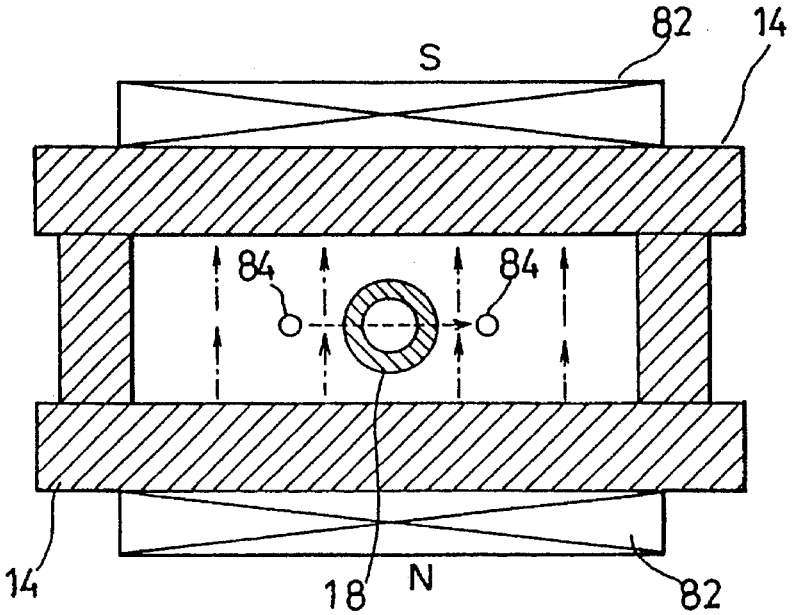

In the present invention, for the purpose of restricting the flow of the molten steel from the discharge port of the straight immersion nozzle, the restricting force due to excitation may be applied to the molten steel in the vicinity of the discharge port of the nozzle. FIGS. 29(*a*) and 29(*b*) show such an example. A static magnetic field generator 82 is disposed on the back surfaces of the long side walls 14 and 14 of a continuous casting mold 10, and exciting terminals 84 are disposed directly near the discharge port of the nozzle for applying a direct current in the direction perpendicular to the short side surface of the casting. In FIG. 29, the directions of the magnetic field B, the current I and the electromagnetic force F in the molten steel are shown as a chain line, dashed line and a two-dot chain line, respectively. With this construction, in the present invention, since the static magnetic field is generated in the molten steel within the mold in the direction perpendicular to the long side surface of the casting, and simultaneously the direct current is applied in the direction perpendicular to the short side surface of the casting by the exciting terminals 84, it is possible to form the upward electromagnetic force F with respect to the casting direction, and hence to disperse the downward flow from the nozzle. This makes it possible to suppress the permeation of the inclusions and the babbles in the casting. The exciting terminals may be embedded in the refractories of the straight immersion nozzle 18.

WORKING EXAMPLE 1

The experiment was made using a two-strand type continuous casting machine including a continuous casting apparatus as shown in FIG. 1. Low carbon aluminum-killed steel containing an oxygen concentration of 28–30 ppm was continuously cast by three charges using a straight immersion nozzle of the present invention. The casting condition is as follows. In addition, the injected amount of gas for preventing the nozzle blocking was 12N1/min.

Size of the casting mold: 220 mm in thickness 1600 mm in width 800 mm in height

Superheat of molten steel in tundish: 29°–34° C.

Throughput: 1.5 ton/min

At one strand, the casting was made under the condition of using the straight nozzle of the present invention and applying only one-stage static magnetic field. At the other strand, the casting was made under the condition of no magnetic field. FIGS. 1(*a*) and 1(*b*) are schematic views showing the application of the one-stage static magnetic field. The specification of a static magnetic field generator 22 is as follows:

One stage static magnetic generator:

Size: 1700 mm in width, 50–650 mm (L) in height

Maximum magnetic flux density: 0.05–0.5T

By changing the discharge flow rate <v> of the molten steel depending on the throughput, and further, by changing both the applied magnetic field intensity and the applied magnetic field range L, the defects caused in the cold-rolled materials were observed. Thus, this working example was compared with the no magnetic field casting. FIG. 2 shows a relationship between the applied magnetic field range L (mm) and the magnetic flux density (T), assuming that the flow rate from the nozzle discharge port is specified at 0.9 m/sec or less.

As is apparent from FIG. 2, as compared with the no magnetic field casting, the generation rate of defects in this working example is improved to be 0.45 or less in a region where the factor k=B·L obtained by the magnetic flux density B (X-axis) and the applied magnetic field range L (y-axis) is 25 or more, the applied magnetic filed range L is 80 mm or less, and the magnetic flux density B is 0.07T or more. Also, for the case that the discharge flow rate is 0.9 m/sec or more, there were obtained the results as shown in Table 1.

TABLE 1

| Flow rate v (m/sec) | Condition B × L, B (T), L (mm) | Generation rate of defect (in no magnetic field casting:1) |
|---|---|---|
| v ≦ 1.5 | B × L ≧ 27, B ≦ 0.08 T, L ≧ 90 mm | Less than 0.45 |
| v ≦ 2.0 | B × L ≧ 30, B ≧ 0.09 T, L ≧ 100 mm | Less than 0.45 |
| v ≦ 2.5 | B × L ≧ 33, | Less than 0.45 |

TABLE 1-continued

| Flow rate v (m/sec) | Condition B × L, B (T), L (mm) | Generation rate of defect (in no magnetic field casting:1) |
|---|---|---|
| | B ≧ 0.09 T, L ≧ 110 mm | |
| v ≦ 3.0 | B × L ≧ 35, B ≧ 0.1 T, L ≧ 110 mm | Less than 0.45 |
| v ≦ 3.8 | B × L ≧ 36, B ≧ 0.11 T, L ≧ 120 mm | Less than 0.45 |
| v ≦ 4.8 | B × L ≧ 38, B ≧ 0.12 T, L ≧ 120 mm | Less than 0.45 |
| v ≧ 5.5 | B × L ≧ 40, B ≧ 0.12 T, L ≧ 130 mm | Less than 0.45 |

WORKING EXAMPLE 2

Figure 3B:
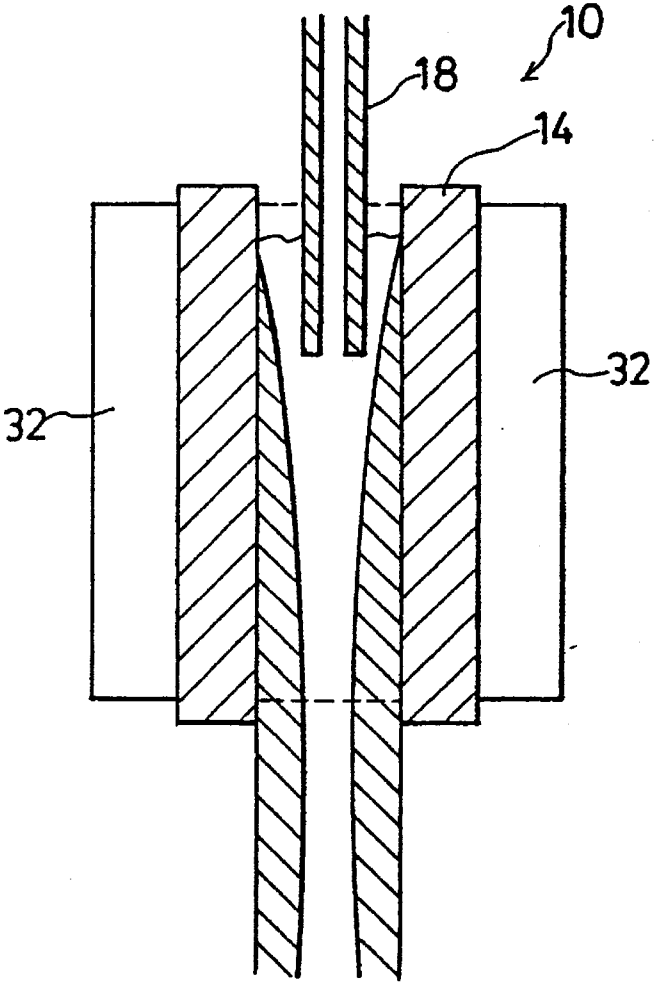
FIGS. 3(*a*) and 3(*b*) are sectional views showing the construction of a continuous casting apparatus used in Working example 2.
Figure 3A:
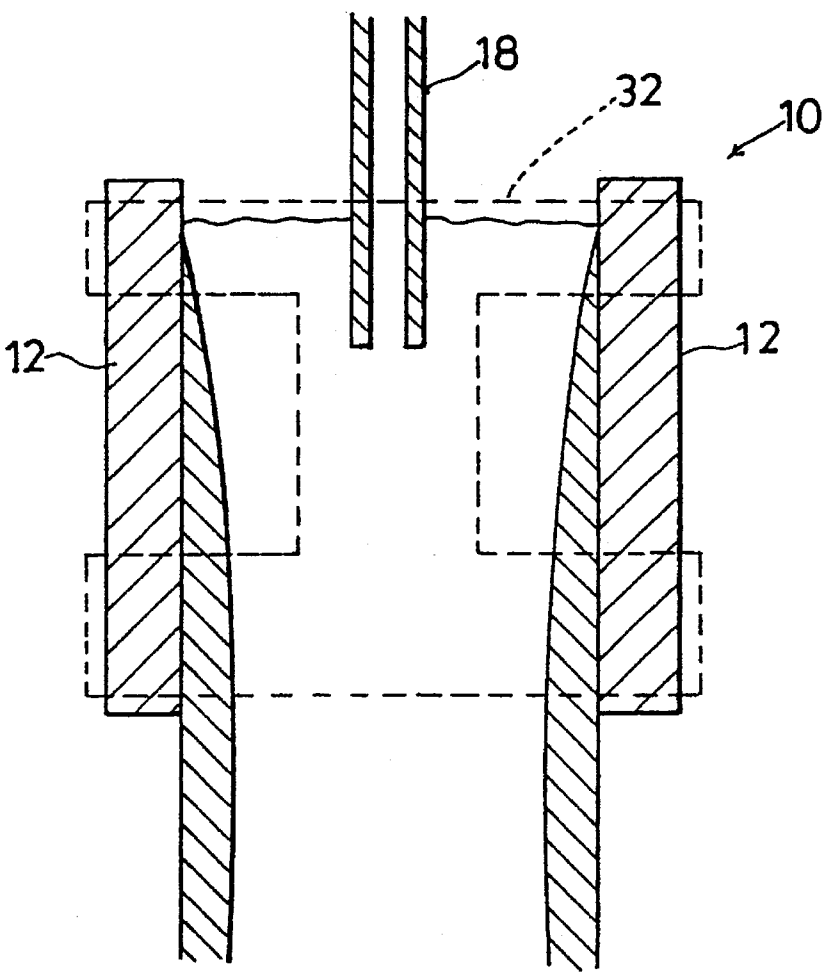

FIGS. 3(*a*) and 3(*b*) show a continuous casting apparatus including an I-shaped static magnetic field generator 32. The I-shaped static magnetic field generator 32 applies the static magnetic field to the range of the flow of the molten steel discharged from a straight immersion nozzle 18, and restricts both the downward flow of the discharged molten steel spreading in the width direction and the flow spreading toward the meniscus forming the variation of the molten pool surface.

Figure 4:
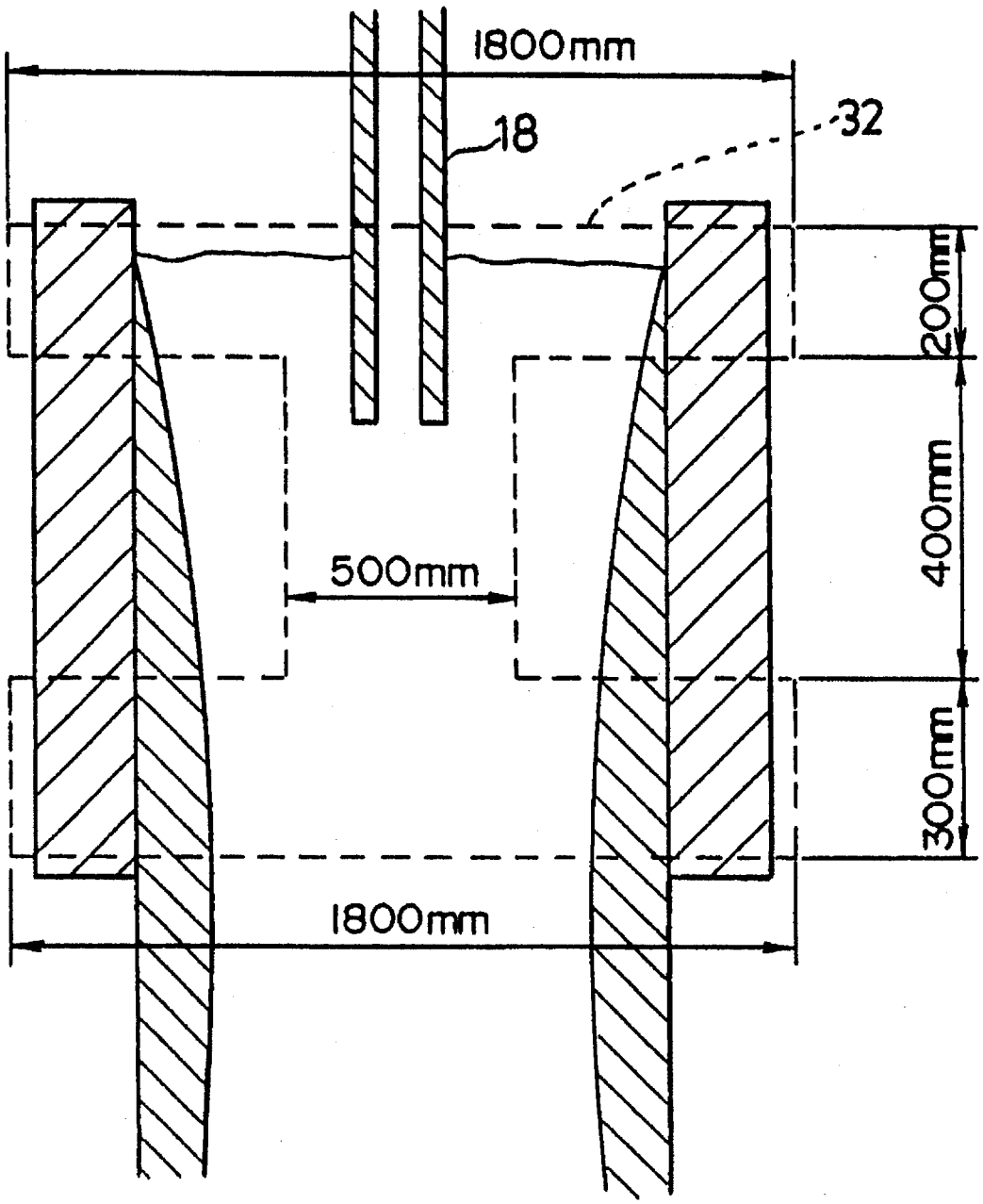
FIG. 4 is a sectional view showing the construction of the continuous casting apparatus used in Working example 2 with the main dimensions.

By use of the straight immersion nozzle 2, the continuous casting was made in a manner to restrict the molten steel supplied in a continuous casting mold 10 in the magnetic pole region of the I-shaped static magnetic field generator 32 disposed to the continuous casting mold 10 (see FIGS. 3(*a*) and 3(*b*)). The concrete dimensions of the static magnetic field generator 32 are shown in FIG. 4.

Using the two-strand continuous casting machine, the molten steel adjusted by ladle refining and containing a C concentration of 360–450 ppm, an Al concentration of 450–620 ppm, and an oxygen concentration of 27–30 ppm was continuously cast by three charges (280t/charge) under the condition described later. After casting, the alumina depositing states within the immersion nozzles were examined. At one strand, the conventional two-hole type immersion nozzle was used. At the other strand, the straight immersion nozzle 18 of the present invention was used and the above static magnetic field generator 32 was provided.

The casting condition is as follows:

Size of mold: 220 mm (short side), 1600 mm (long side)

Casting speed: 1.7 m/min

Superheat of molten steel in tundish: 25°–30° C.

Maximum magnetic flux in static magnetic field generator: 3000 gauss

As a result, in the continuous casting using the conventional two-hole type immersion nozzle into which Ar gas was injected at an injection rate of 10Nl/min for preventing the nozzle blocking, there was recognized an alumina depositing layer having a thickness of 10 mm at maximum in the vicinity of the nozzle discharge port. On the other hand, in the continuous casting using the straight immersion nozzle and the I-shaped static magnetic field generator 32, in spite of no injection of Ar gas into the nozzle, it was recognized that an alumina depositing layer was about 2 mm at maximum, and therefore, the nozzle blocking was extremely small.

WORKING EXAMPLE 3

The molten steel containing an oxygen concentration of 15–18 ppm was obtained by ladle refining, wherein Al power was added within the ladle on the slag on the bath surface of the molten steel having the same composition as in Working example 2 for reducing the FeO in the slag on the molten steel in the ladle to be 3% or less in concentration. The above molten steel was continuously cast by three charges (280t/charge) under the same condition as in Working example 2. Then, the alumina depositing states within the immersion nozzles were examined. In this working example, for both strands, the gas for preventing the nozzle blocking was not injected in the immersion nozzles.

As a result, in the conventional casting using the two-hole immersion nozzle, the nozzle blocking was generated at the third charge, so that the specified injection rate was not achieved and thus the casting speed was reduced from 1.7 m/min to 1.2 m/min. On the other hand, in the continuous casting using the straight immersion nozzle, the casting speed was not reduced. After the casting, the inner surface of the recovered straight immersion nozzle was observed, which gave the result that the alumina was deposited thereon only to a thickness of about 1–2 mm.

In addition, the experiment using the straight immersion nozzle without the static magnetic field was made separately. In the above, the jet of the high temperature molten steel discharged from the leading edge of the nozzle was made to strongly flow downwardly in the vertical direction to wash the solidified shell, thereby obstructing the progress of solidification of the portion. Thus, the so-called breakout was generated, and thereby the casting was made impossible. On the contrary, in Working examples 2 and 3 using the straight nozzle with the static magnetic field, as described above, the stable casting was made possible.

The continuous casting slabs obtained in Working examples 2 and 3 were hot-rolled and cold-rolled to a thickness of 0.7 mm. The cold-rolled steel plates thus obtained were examined for the generation rate of the surface defects (total of blistering defects and sliver defects). The results are shown in FIG. 5.

Figure 5:
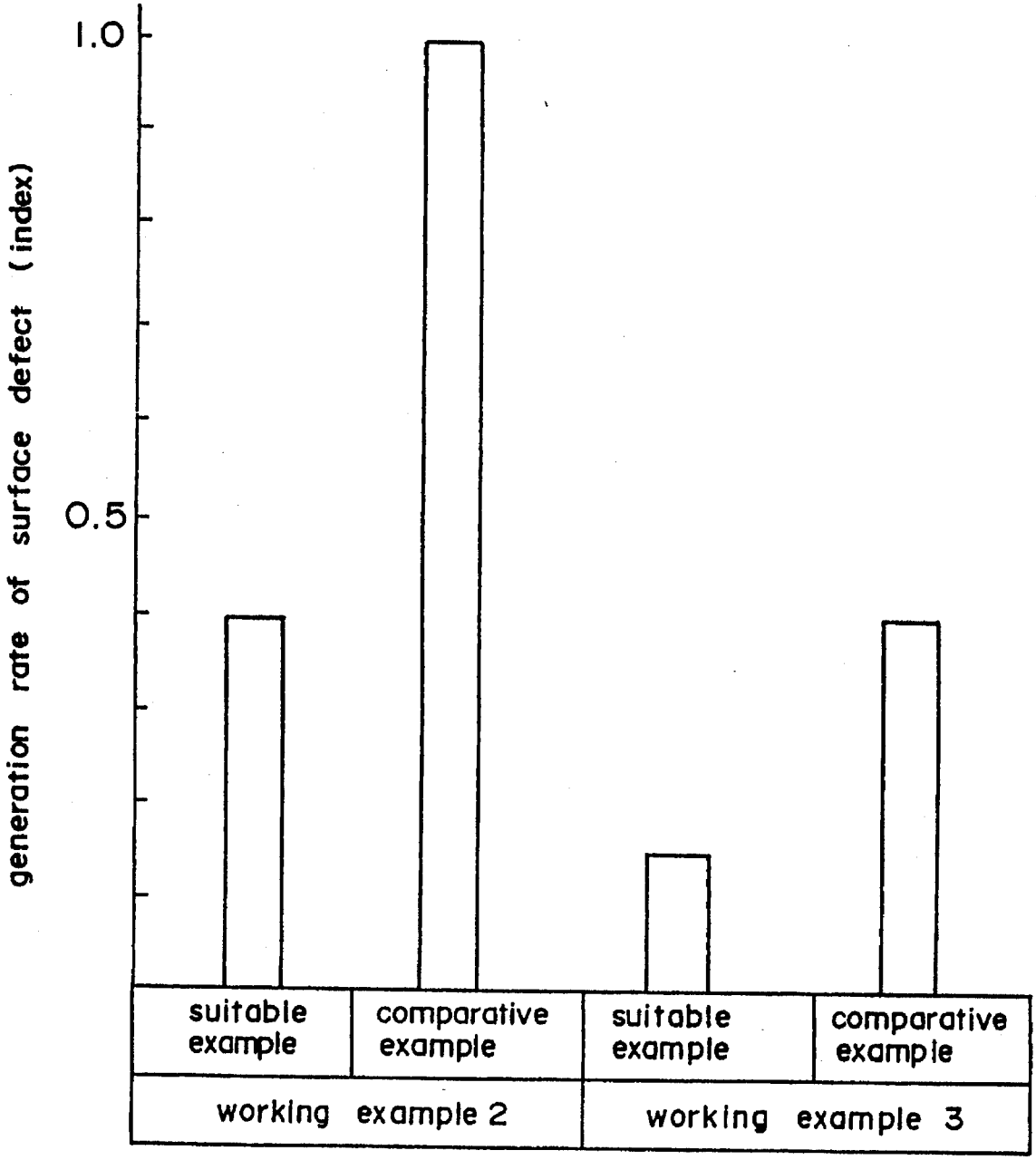
FIG. 5 is a bar graph for comparatively showing the results of Working example 2 in terms of the generation rate (index) of the surface defects.

As is apparent from FIG. 5, it is revealed that the generation rate of the surface defects is extremely small in the continuous casting according to the present invention. The reason for this is as follows: namely, by the application of the static magnetic field to the continuous casting mold, the pouring flow of the molten steel is prevented from permeating to the deep portion of the crater; and the flow of the molten steel at the meniscus is restricted, thereby eliminating the entrapment of the mold powder. Also, the reason why the result obtained from the suitable example in Working example 3 is more preferable than that in Working example 2 is considered as follows: namely, the oxygen concentration in the molten steel is low and the Ar gas injection as a main cause of generating the blistering defects is not performed. In addition, even in the comparative example in Working example 3, the fairly preferable result is obtained; however, since the gas for preventing the nozzle blocking is not injected in the nozzle, the nozzle blocking is generated, thereby making it impossible to obtain the desired casting speed, which brings about the problem in productivity.

WORKING EXAMPLE 4

Figure 6B:
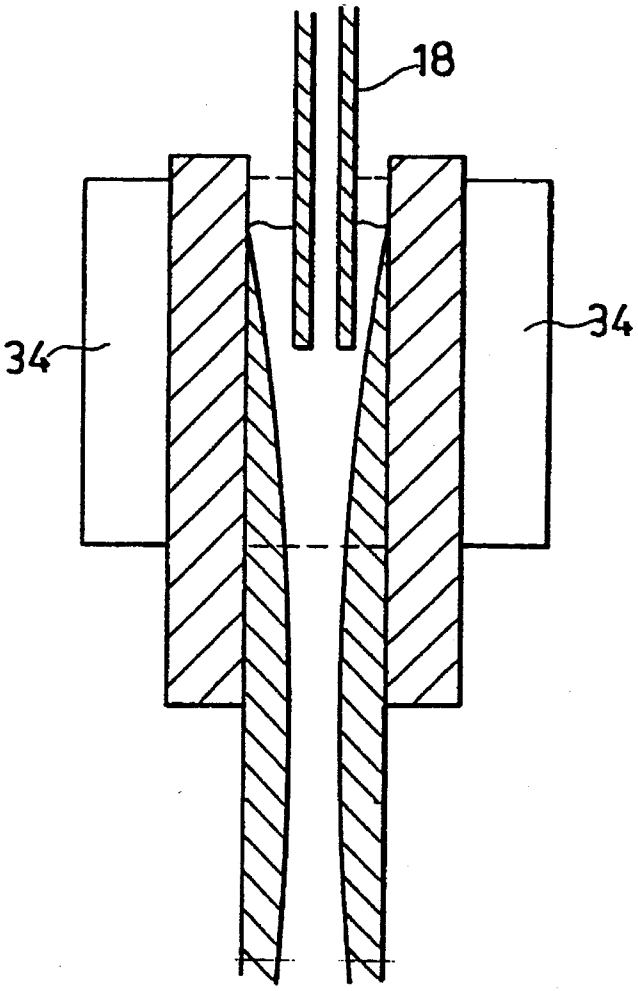
FIGS. 6(*a*) and 6(*b*) are sectional views showing the construction of a continuous casting apparatus used in Working examples 4 and 5.
Figure 6A:
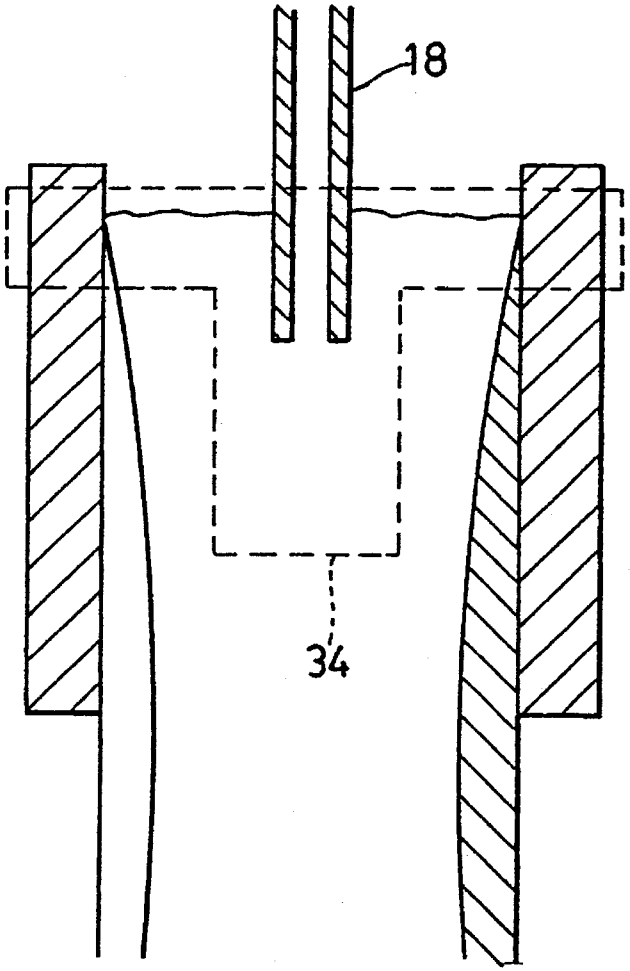

By use of a two-strand type continuous casting machine including a T-shaped static magnetic field generator as shown in FIG. 6, the molten steel adjusted by ladle refining and containing a C concentration of 380–500 ppm, an Al concentration of 450–550 ppm and an oxygen concentration of 25–28 ppm, was continuously cast by three charges (300t/charge) under the condition described later. After casting, the alumina depositing states within the straight immersion nozzles were examined.

Figure 7:
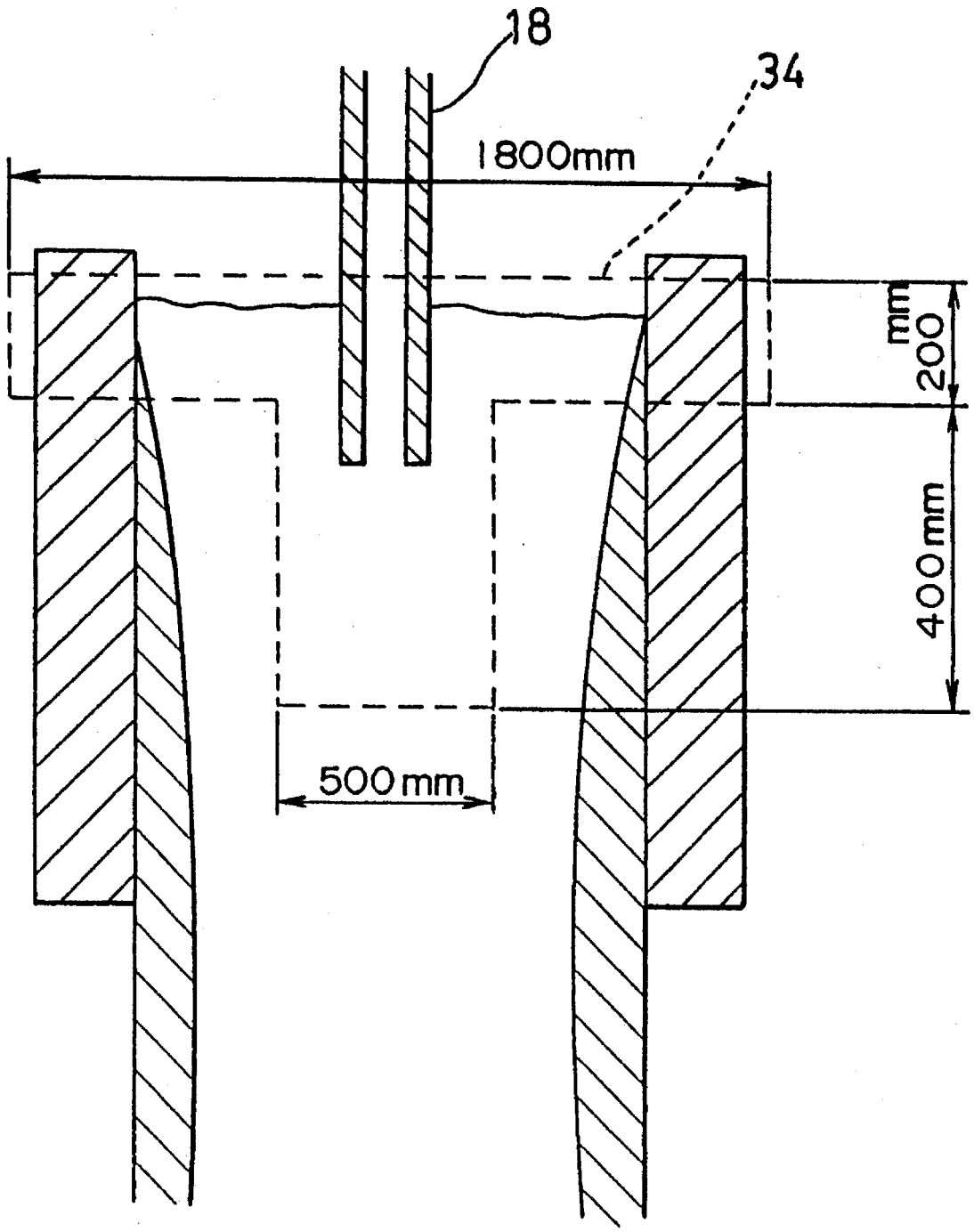
FIG. 7 is a sectional view showing the disposition of the continuous casting apparatus used in Working examples 4 and 5 with the main dimensions.

At one strand, a straight immersion nozzle 18 was used and a T-shaped static magnetic field generator 34 was disposed in such a dimensional relation as shown in FIG. 7. At the other strand, the conventional two-hole type immersion nozzle was used.

The casting condition was as follows:

Size of mold: 215 mm (short side), 1600 mm (long side)

Casting speed: 1.6 m/min

Superheat of molten steel in tundish: 20°–25° C.

Maximum magnetic flux in static magnetic field generator: 3200 gauss

As a result, in the continuous casting using the conventional two-hole type immersion nozzle into Which Ar gas was injected at an injection rate 10Nl/min for preventing the nozzle blocking, there was recognized an alumina depositing layer having a thickness of 10 mm at maximum in the vicinity of the nozzle discharge port. On the other hand, in the continuous casting using the straight immersion nozzle with the static magnetic field, in spite of no injection of Ar gas into the nozzle, it was recognized that an alumina depositing layer was about 2 mm at maximum, and therefore, the nozzle blocking was extremely small.

WORKING EXAMPLE 5

The molten steel containing an oxygen concentration of 12–18 ppm was obtained by ladle refining, wherein Al power was added within the ladle on the slag on the bath surface of the molten steel having the same composition as in Working example 4 for reducing the FeO in the slag on the molten steel in the ladle to be 2% or less in concentration. The above molten steel was continuously cast by three charges (300t/charge) under the same condition as in Working example 4. Thus, the alumina depositing states within the immersion nozzles were examined. In this working example, for both strands, the gas for preventing the nozzle blocking was not injected in the immersion nozzles.

As a result, in the conventional casting using the two-hole immersion nozzle, the nozzle blocking was generated at the third charge, so that the specified injection rate was not achieved and thus the casting speed was reduced from 1.6 m/min to 1.1 m/min. On the other hand, in the continuous casting according to this working example, the casting speed was not reduced. After the casting, the inner surface of the recovered straight immersion nozzle 18 was observed, which gave the result that the alumina was deposited thereon only to a thickness of about 1–2 mm.

In addition, the experiment using the straight immersion nozzle 18 without the static magnetic field was made separately.

In the above, the jet of the high temperature molten steel discharged from the leading edge of the nozzle was made to strongly flow downwardly in the vertical direction to wash the solidified shell, thereby obstructing the progress of solidification of the portion. Thus, the so-called breakout was generated, and thereby the casting was made impossible. On the contrary, in Working examples 4 and 5 using the static magnetic field 34, as described above, the stable casting was made possible.

The continuous casting slabs obtained in Working examples 4 and 5 were hot-rolled and cold-rolled to a thickness of 0.8 mm. The cold-rolled steel plates thus obtained were examined for the generation rate of the surface defects (total of blistering defects and sliver defects). The results are shown in FIG. 8.

Figure 8:
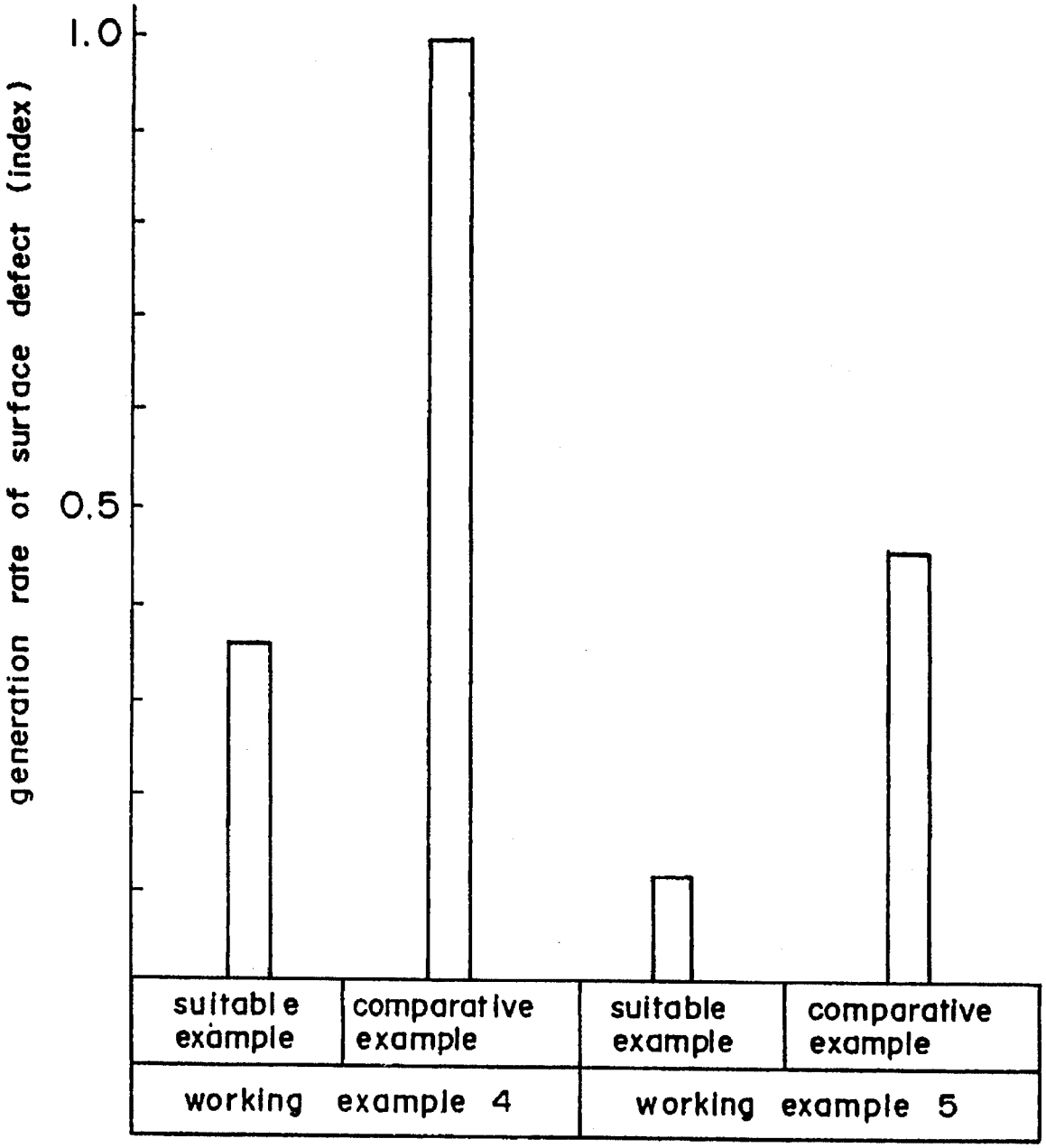
FIG. 8 is a bar graph for comparatively showing the results of Working examples 4 and 5 in terms of the generation (index) in the surface defects.

As is apparent from FIG. 8, it is revealed that the generation rate of the surface defects is extremely small in the suitable example. The reason for this is as follows: namely, by the application of the static magnetic field to the continuous casting mold, the pouring flow of the molten steel is prevented from permeating to the deep portion of the crater; and the flow of the molten steel at the meniscus is restricted, thereby eliminating the entrapment of the mold powder. Also, the reason why the result obtained from the suitable example in Working example 5 is more preferable than that in Working example 4 is considered as the follows: namely, the oxygen concentration in the molten steel is low and the Ar gas injection as a main cause of generating the blistering defects is not performed. In addition, even in the comparative example in Working example 5, the fairly preferable result is obtained; however, since the gas for preventing the nozzle blocking is not injected in the nozzle, the nozzle blocking is generated, thereby making it impossible to obtain the desired casting speed, which brings about the problem in productivity.

WORKING EXAMPLE 6

Next, as illusted in FIG. 9, the casting experiments were made as follows: At one strand, a straight injection nozzle 18 was used and static magnetic field generators 26 and 28 were disposed on the upper and lower sides for applying the upper and lower static magnetic fields in two stages. At the other strand, the conventional two-hole type immersion nozzle was used as a comparative example. In the casting, the gas for preventing the nozzle blocking was injected at an injection rate of 10Nl/min in both the above strands. The other casting condition was the same as in Working example 1.

The specifications of the upper and lower static magnetic field generators are as follows:

Upper static magnetic field generator:

Size: 1700 mm in width, 50–320 mm ($L_1$) in height

Maximum magnetic flux density: 0.05–0.6T

Interval between magnetic poles: 300 mm (from lower end of upper static magnetic field generator to upper end of lower static magnetic field generator)

Lower static magnetic field generator:

Size: 1700 mm in width, 50–320 mm ($L_2$) in height

Maximum magnetic flux density: 0.05–0.5T

Whole range of magnetic poles: $L_1+L_2$=100–640 mm

Assuming that the discharge flow rate is less than 0.9 m/sec, by changing the discharge flow rate <v>, the magnetic flux density B and the applied magnetic field range L, the generation rates of defects were obtained. Ther results are shown in FIG. 10. In this figure, the generation rates of defects in this working example are indicated as circular marks (less than 0.45), triangular marks (0.45–0.7) and X marks (0.7 or more), with the generation rate of defects in the cold-rolled material obtained by the no magnetic field casting being taken as 1.

As is apparent From FIG. 10, the generation rate of defects in this example becomes less than 0.45 in a region where the factor k=B·L obtained by the magnetic flux density B (X-axis) and the applied magnetic field range L (y-axis) is 16 or more. As a result, it becomes clear that the applied magnetic field range is more preferable as compared with the case using the one-stage magnetic field.

Even in the case that the discharge flow rate becomes larger than the value of 0.9 m/sec, similarly, the flow of the molten steel was able to be controlled by applying the two-stage static magnetic field. The results are shown in Table 2. As is apparent from Table 2, by applying the two-stage static magnetic field, it is possible to extremely improve the quality as compared with the no magnetic casting even when the applied magnetic field range and the applied magnetic field intensity are small.

TABLE 2

| Flow rate v (m/sec) | Condition B × L, B (T), L (mm) | Generation rate of defect (in no magnetic field casting:1) |
|---|---|---|
| v ≦ 1.5 | B × L ≧ 18, B ≧ 0.07 T, L ≧ 70 mm | Less than 0.45 |
| v ≦ 2.0 | B × L ≧ 19, B ≧ 0.08 T, L ≧ 70 mm | Less than 0.45 |
| v ≦ 2.5 | B × L ≧ 20, B ≧ 0.09 T, L ≧ 80 mm | Less than 0.45 |
| v ≦ 3.0 | B × L ≧ 21, B ≧ 0.1 T, L ≧ 90 mm | Less than 0.45 |
| v ≦ 4.0 | B × L ≧ 22, B ≧ 0.11 T, L ≧ 100 mm | Less than 0.45 |
| v ≦ 5.0 | B × L ≧ 24, B ≧ 0.12 T, L ≧ 100 mm | Less than 0.45 |
| v ≦ 6.0 | B × L ≧ 40, B ≧ 0.13 T, L ≧ 110 mm | Less than 0.45 |

WORKING EXAMPLE 7

Figure 11B:
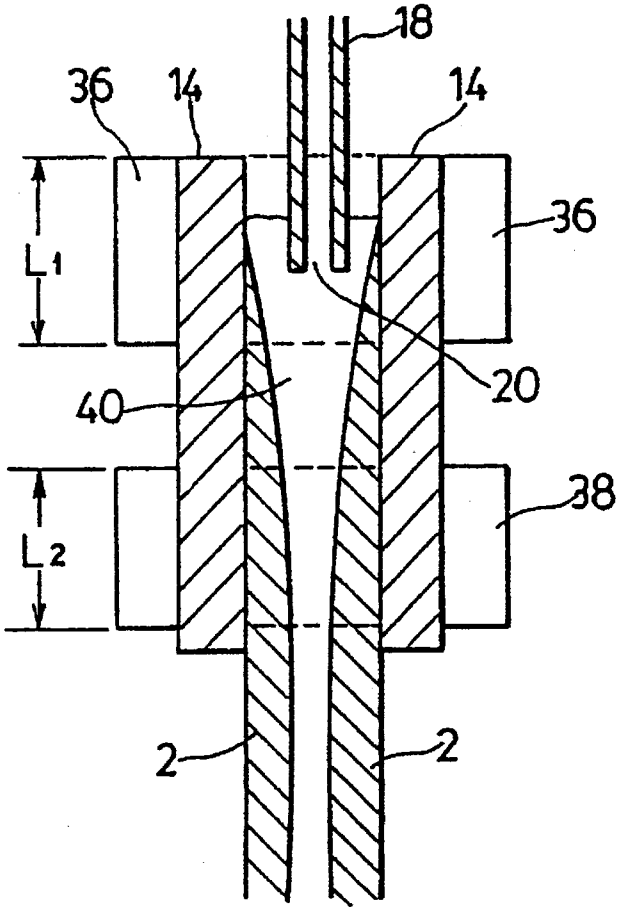
FIGS. 11(*a*) and 11(*b*) are schematic sectional views showing the construction of the main portion of a continuous casting apparatus including two-stage static magnetic field generator used in Working example 7.
Figure 11A:
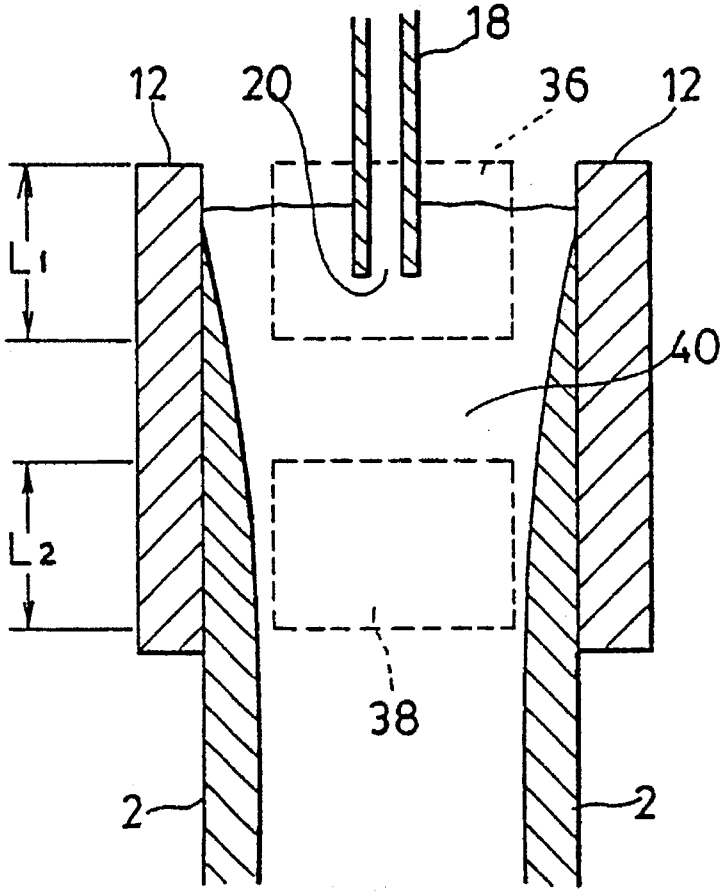

The experiments were made under the same condition as in Working example 6 for comparing the method of applying the magnetic field to the whole width of the mold as shown in FIG. 11(*b*), with the method of applying the magnetic field to the partial width of the mold as shown in FIG. 11(*a*). Further, for comparison, casting was made by the conventional manner. On the basis of the results of the above experiments, the difference according to the method of applying the magnetic field was examined. By use of a two-strand continuous casting machine, a low carbon aluminum-killed steel containing an oxygen concentration of 20–24 ppm was continuously cast. In both the strands, the gas for preventing the nozzle blocking was injected at an injection rate of 10N1/min. The casting condition is as follows:

Size of casting mold: 220 mm in thickness 1600 mm in width 800 mm in height

Superheat of molten steel in tundish: 28°–33° C.

Casting speed: 3.0 m/min

The specification of the partial static magnetic field generator is as follows:

Upper static magnetic field generator:

Size: 800 mm in width, 300 mm in height

Maximum magnetic flux density: 0.31T

Interval of magnetic poles: 300 mm (from lower end of upper magnetic field generator to upper end of lower static magnetic field generator)

Lower static magnetic field generator:

Size: 800 mm in width, 300 mm in height

Maximum magnetic flux density: 0.31T

Also, the specification of the whole static magnetic field generator is as follows:

Upper static magnetic field generator:

Size: 1700 mm in width, 300 mm in height

Maximum magnetic flux density: 0.31T

Interval of magnetic poles: 300 mm (from lower end of upper magnetic field generator to upper end of lower static magnetic field generator)

Lower static magnetic field generator:

Size: 1700 mm in width, 300 mm in height

Maximum magnetic flux density: 0.31T

Figure 12:
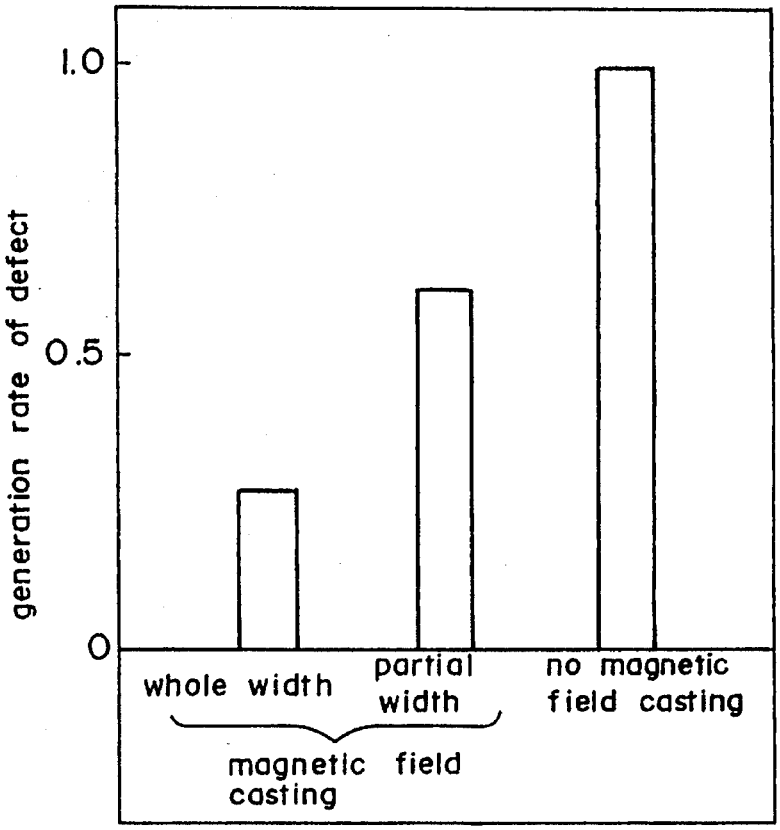
FIG. 12 is a bar graph for comparatively showing the experimental results in the cases of using the partial static magnetic field generator (Working example 7) and the whole width static magnetic field generator (Working example 6) and no magnetic field (Comparative example)

The results are shown in FIG. 12. As is apparent from FIG. 12, the generation rate of defects becomes extremely smaller in the case of applying the static magnetic field in the width of 1700 mm. Accordingly, it becomes clear that the application of the static magnetic field over the whole width of the mold is effective to improve the quality.

WORKING EXAMPLE 8

The experiments were made according to the casting process using the straight nozzle of the present invention and applying the static magnetic fields in multi-stage with the gap portion, for comparing the case that the upper stage magnetic field included the meniscus and the vicinity of the discharge port of the immersion nozzle, with the case that it included only the discharge port of the immersion nozzle. The experiments were made using a two-strand continuous casting machine, under the following condition:

Size of mold: 220 mm in thickness 1600 mm in width 800 mm in height

Superheat of molten steel in tundish: 24°–30° C.

Casting speed: 1.9 m/min

A low carbon aluminum-killed steel containing an oxygen concentration of 28 ppm was continuously cast by three charges. The gas for preventing the nozzle blocking was injected at an injection rate of 12N1/min.

The specification of the multi-stage type static magnetic field generator is as follows:

Upper static magnetic field generator:

Size: 1700 mm in width, 250 mm in height

Maximum magnetic flux density: 0.27T

Interval of magnetic poles: 300 mm (from lower end of upper magnetic field generator to upper end of lower static magnetic field generator)

Lower static magnetic field generator:

Size: 1700 mm in width, 250 mm in height

Maximum magnetic flux density: 0.27T

Figure 13:
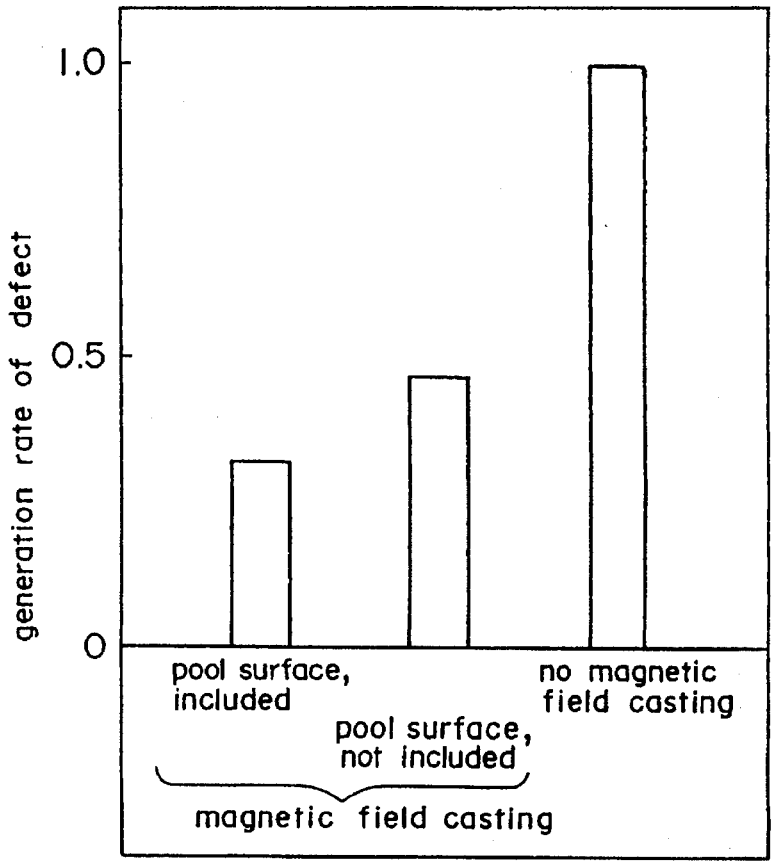
FIG. 13 is a bar graph for comparatively showing the experimental result in the cases that the static magnetic field generator is disposed at the height including the pool surface, and that it is disposed at the height not including the pool surface, and further the case with no static magnetic field.

In this case, the comparative experiments were made between the case that the upper magnetic field generator is disposed at the height including the molten pool surface, and the case that it is disposed at the height not including the molten pool surface. Further, for comparison, the conventional casting was made. The generation rates of defects in this working example were standardized, with the generation rate of defects in the conventional casting being taken as 1. As is apparent from FIG. 13, according to the present invention, the generation rate of defects is smaller in the case that the static magnetic field is disposed at the height including the molten pool surface.

WORKING EXAMPLE 9

To examine the blocking state of the nozzle in casting without injection of the gas for preventing the nozzle blocking, the experiments were made under the following condition. A low carbon aluminum-killed steel adjusted by ladle refining to be reduced in an oxygen concentration of 15–20 ppm was continuously cast.

Size of casting mold: 220 mm in thickness 1600 mm in width 800 mm in height

Superheat of molten steel in tundish: 28°–33° C.

Casting speed: 2.2 m/min

In the experiments required for the gas injection in both the conventional casting and the magnetic field applying casting, the gas for preventing the nozzle blocking was injected at an injection rate of 12Nl/min.

The specification of the multi-stage type static magnetic field generator is as follows:

Upper static magnetic field generator:

Size: 1700 mm in width, 270 mm in height

Maximum magnetic flux density: 0.29T

Interval of magnetic poles: 300 mm (from lower end of upper magnetic field generator to upper end of lower static magnetic field generator)

Lower static magnetic field generator:

Size: 1700 mm in width, 270 mm in height

Maximum magnetic flux density: 0.29T

In the casting using the straight nozzle, even when the gas injection from the nozzle was not performed, there was recognized the deposited inclusions in a thickness of about 1 mm within the nozzle after being used by three charges, which gave the result almost equivalent to that obtained in the case of performing the gas injection.

Figure 14:
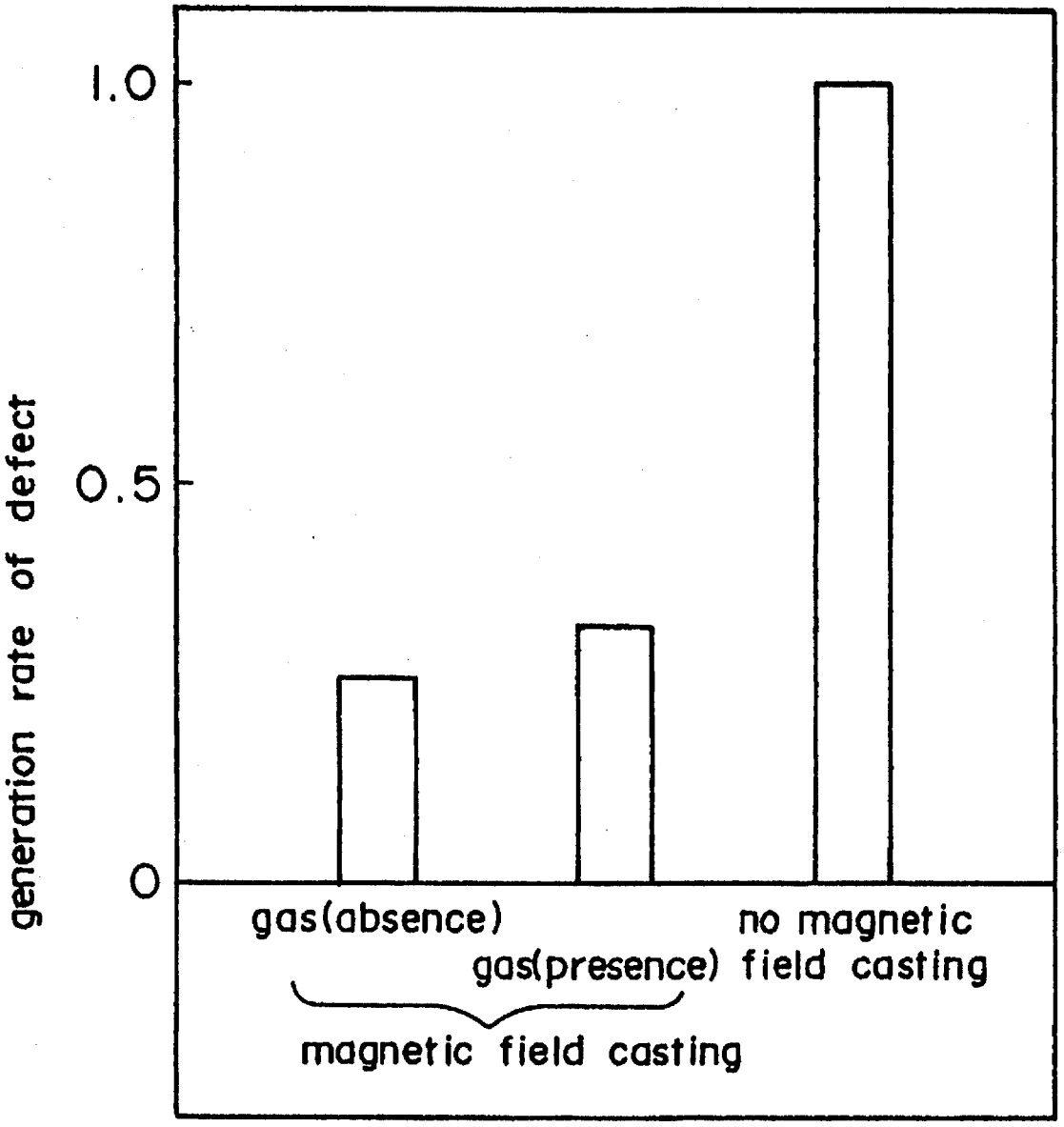
FIG. 14 is a bar graph for comparatively showing the experimental results in the cases with gas injection, and without gas injection, and further the case with no static magnetic field.

FIG. 14 shows the generation rate of defects of this working example. As is apparent from FIG. 14, the generation rate of defects is reduced in the case without the gas injection. Accordingly, by performing the casting without the gas injection, it is possible to obtain the steel plate excellent in cleanliness. Incidentally, even in the case of performing the gas injection, the generation rate of defects is sufficiently reduced.

WORKING EXAMPLE 10

Figure 15B:
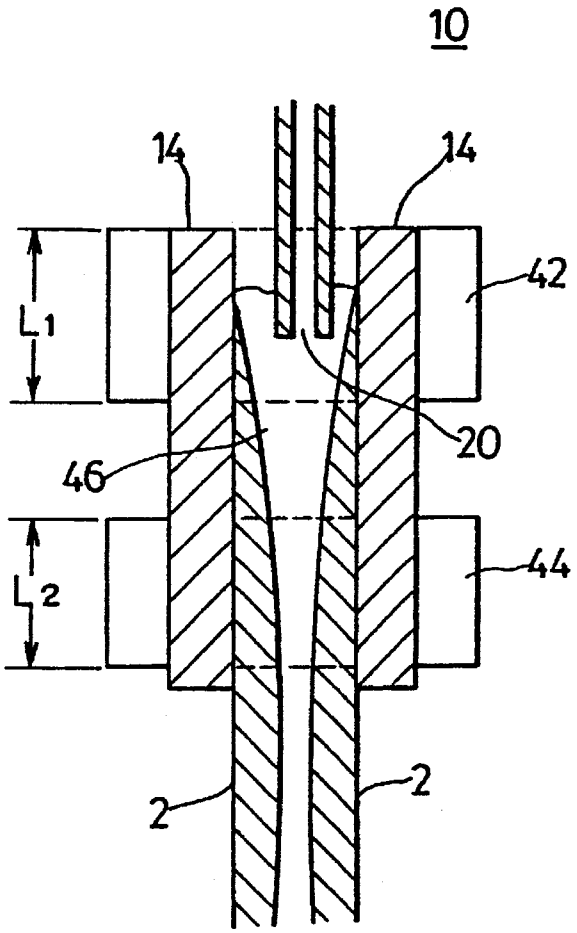
FIGS. 15(*a*) and 15(*b*) are sectional views of a continuous casting apparatus including a two-stage (upper and lower) static magnetic field generator used in Working examples 10 and 11.
Figure 15A:
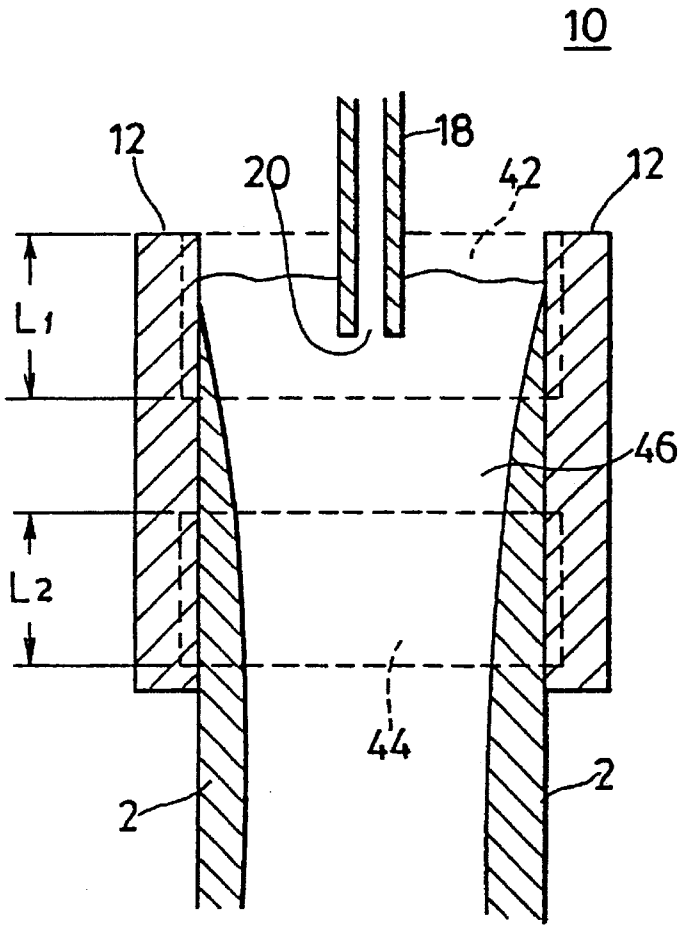

The continuous casting was made using a continuous casting apparatus as shown in FIGS. 15(*a*) and 15(*b*). As shown in FIGS. 15(*a*) and 15(*b*), there was used a straight immersion nozzle 18 having a straight discharge port 20 being opened at the leading edge of the nozzle main body. Further, upper and lower static magnetic fields 42 and 44 were applied.

The upper static magnetic field generator 42 disposed to a continuous casting mold 10 makes quiet the surface of the molten steel supplied within the mold 10 while restricting the molten steel in the magnetic pole range, and further, equalizes the descending flow of the molten steel at a gap portion 46. Also, the lower static magnetic field generator 44 restricts the molten steel during casting.

By use of a two-strand continuous casting machine, a low carbon aluminum-killed steel containing an oxygen concentration of 20–30 ppm was continuously cast by three charges using the immersion nozzle of the present invention. The casting condition is as follows:

Size of mold: 200 mm in thickness 1500 mm in width 800 mm in height

Superheat of molten steel in tundish: about 30° C.

Casting speed: 2.0 m/min

At one strand, a straight immersion nozzle 18 was used and the upper and lower static magnetic fields 42 and 44 were applied. At the other strand, the conventional two-hole type immersion nozzle was used. Also, in both the strands, the gas for preventing the nozzle blocking was injected at an injection rate of 10Nl/min. The specification of the static magnetic field generator is as follows:

Upper static magnetic field generator:

Size: 1700 mm in width, 300 mm ($L_1$) in height

Maximum magnetic flux density: 0.4T

Lower static magnetic field generator:

Size: 1700 mm in width, 300 mm ($L_2$) in height

Maximum magnetic flux density: 0.4T

Interval of magnetic poles: 300 mm (from lower end of upper magnetic field generator to upper end of lower static magnetic field generator)

Whole range of magnetic poles: $L_1+L_2=600$ mm

As a result, in the continuous casting using the conventional two-hole type immersion nozzle, there was recognized the alumina depositing layer having a thickness of 12 mm at maximum in the vicinity of the discharge port of the nozzle. On the contrary, in the continuous casting using the straight immersion nozzle with the static magnetic field, there was recognized the alumina depositing layer having a thickness of 1.0 mm on average at the opening portion of the discharge port. Therefore, it becomes apparent that the nozzle blocking is extremely small in this working example.

WORKING EXAMPLE 11

The experiments were made under the same condition as in Working example 11, except that the gas injection was not performed in both the strands. The casting speed was 2.0 m/min, which was the same as in Working example 10. Also, before the experiments, the molten steel was adjusted by ladle refining to be reduced in an oxygen concentration of 15–20 ppm. As a result, in the casting using the two-hole type immersion nozzle, the opening degree of a sliding nozzle was started to be increased at the second charge, thereby making difficult the essential flow control, and in the period near the end of the pouring process at the third charge, the desired pouring speed was not achieved due to the nozzle blocking, thereby reducing the casting speed. On the contrary, in the casting using the straight immersion nozzle 18 of the present invention and applying the static magnetic fields 42 and 44, the nozzle blocking was not generated and thus the pouring speed was not reduced, as a result of which the casting speed was not reduced.

Both the nozzles were recovered after the experiments, and were compared with each other in the blocking state of the nozzle. In the straight immersion nozzle, there was recognized the depositing alumina having a thickness of 1.0 mm or less on average. On the other hand, in the two-hole type immersion nozzle, there was generated the alumina deposits at the discharge port, and further, the depositing states in the two holes of the immersion nozzle were not uniform, which makes unequal the right and left discharged flows to each other.

Figure 18:
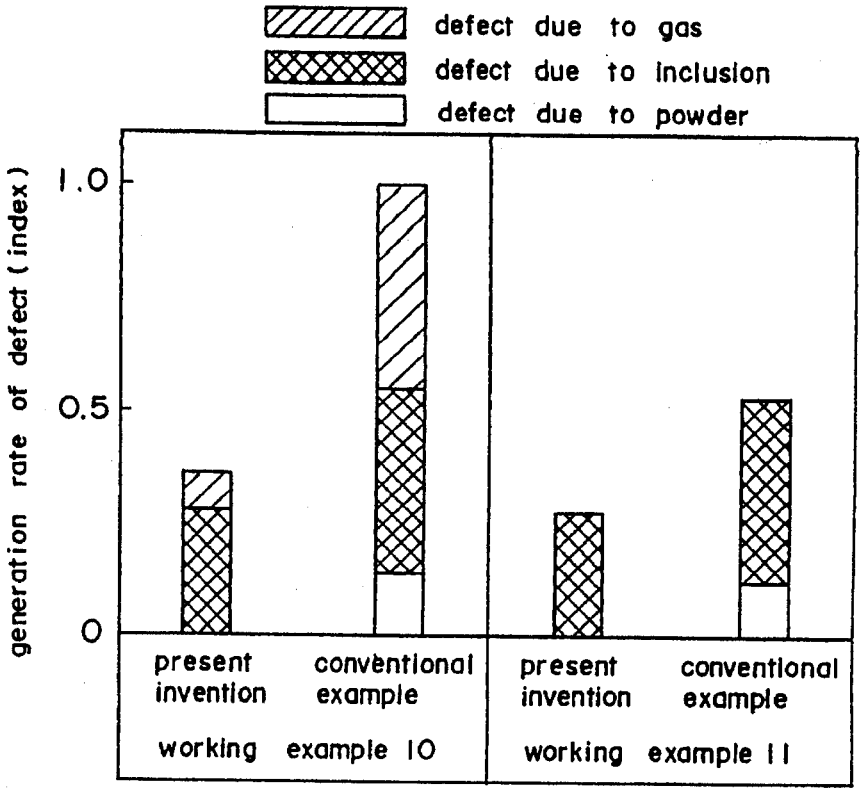
FIG. 18 is a graph for comparatively showing the generation rate of the surface defects in Working examples 10 and 11 and in the conventional example.

FIG. 18 shows the results obtained from Working examples 10 and 11. In FIG. 18, there are shown the defects on average measured by magnetic inspection per unit area of the cold-rolled steel plates which are obtained by hot-rolling and cod-rolling the slabs continuously cast. Further, after the measurement by magnetic inspection, there was examined the causes of the defects. As a result, it was revealed that the defects due to gas, the defects due to inclusions and the defects due to powder were at stake. With the generation rate of surface defects in the cold-rolled plate obtained in Working example 10 being taken as 1, the other generation rates of defects were indicated.

FIG. 18 shows the generation rate of defects in Working examples 10 and 11 in which the casting process of the present invention is compared with the conventional casting. As is apparent from this figure, in the present invention, the internal defects of the slab is remarkably reduced as compared with the conventional casting. As shown in Working example 11 of FIG. 18, particularly, in the case that the cleanliness of the molten steel is high, the nozzle blocking is eliminated, and further, the blowhole defects are never generated because of no gas injection, thus obtaining the preferable results.

WORKING EXAMPLE 12

The experiments were made for comparing a case of applying the two-stage static magnetic field including a gap portion, with a case of applying the one-stage static magnetic field. In either experiment, the straight immersion nozzle was used. The casting condition is as follows. In addition, the injected amount of the gas for preventing the nozzle blocking was specified to be 15N1/min in a total amount from the upper nozzle and the sliding nozzle.

Size of casting mold: 200 mm in thickness 1500 mm in width 800 mm in height

Superheat of molten steel in tundish: about 30° C.

Casting speed: 1.9 m/min

In the above, a low carbon aluminum-killed steel containing an oxygen concentration of 28 ppm was continuously cast by three charges.

Figure 16A:
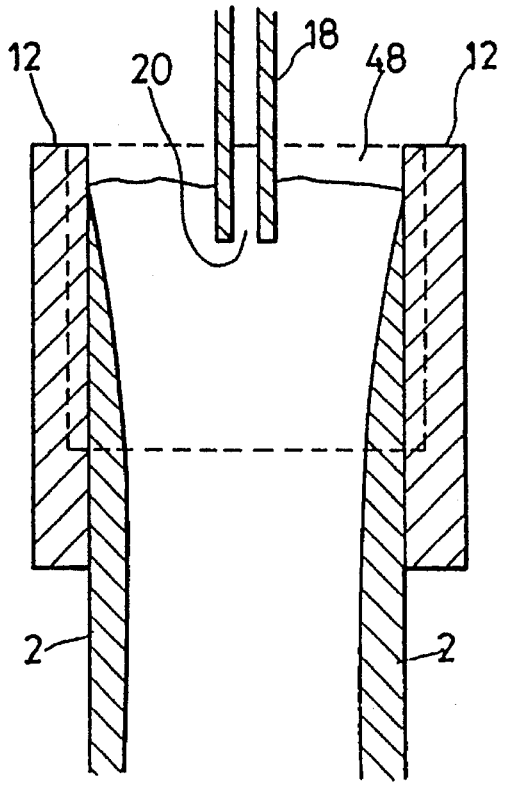
FIGS. 16(*a*) and 16(*b*) are sectional views of a continuous casting apparatus according to the comparative example including a one-stage static magnetic field generator.
Figure 16B:
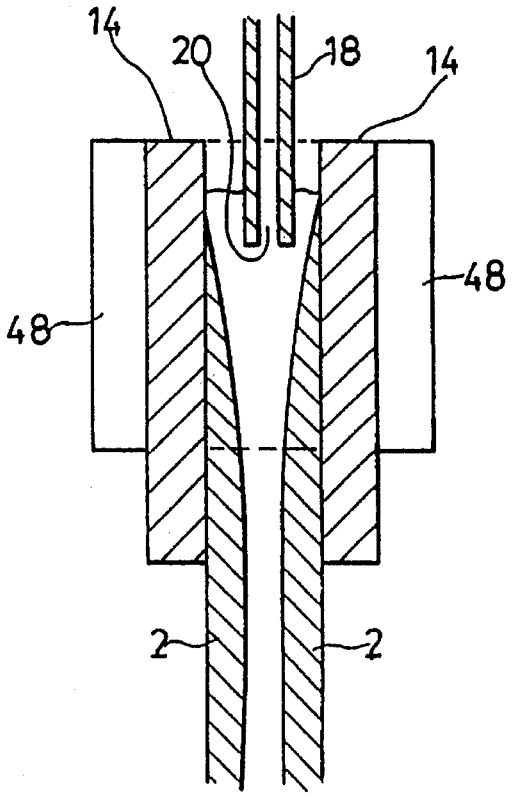
Figure 19:
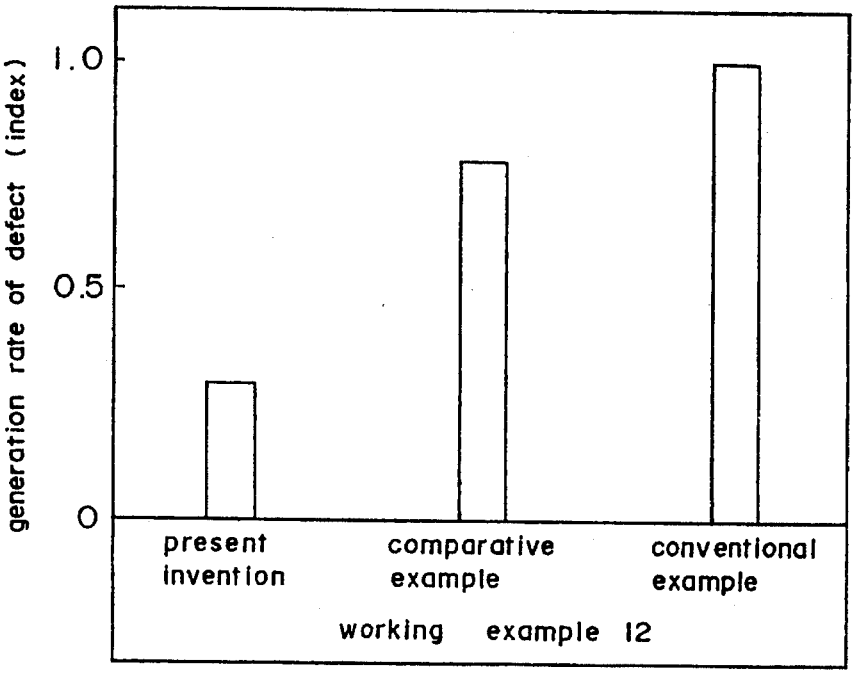
FIG. 19 is a graph for comparatively showing the generation rate of the defects in comparative examples in Working example 12.

FIG. 19 shows the comparison between the experimental result obtained in the case that the two-stage static magnetic field is applied and the nozzle discharge port exists in the upper static magnetic field as shown in FIG. 15, and the experimental result obtained in the case of applying the one-stage static magnetic field as shown in FIG. 16 (comparative example). The specifications of respective static magnetic field generators are as follows:

Two-stage static magnetic field generator

Upper static magnetic field generator:

Size: 1700 mm in width, 300 mm ($L_1$) in height

Maximum magnetic flux density: 0.4T

Lower static magnetic field generator:

Size: 1700 mm in width, 300 mm ($L_2$) in height

Maximum magnetic flux density: 0.4T

Interval of magnetic poles: 300 mm (from lower end of upper magnetic field generator to upper end of lower static magnetic field generator)

Whole range of magnetic poles: $L_1+L_2=600$ mm

One-stage static magnetic field generator

Size: 1700 mm in width, 600 mm (L) in height

Maximum magnetic flux density: 0.4T

FIG. 19 shows the generation rate of defects measured by magnetic inspecting device. With the generation rate of defects in the conventional casting being taken as 1, the generation rates of defects in the working example and the comparative example are shown. As a result, it becomes apparent that the generation rate of the defects in the present invention is small.

The reason why the generation rate of defects is higher in the comparative example as compared with the present invention is that, since there is no gap in the applied magnetic field, the flow of the molten steel is difficult to be diffused as compared with the present invention, so that the discharge flow is difficult to be made the uniform descending flow. Accordingly, the inclusions and babbles are made to run along the discharge flow and to be thus trapped by the shell directly under the nozzle. However, the above comparison is made under the condition of applying the magnetic field, and accordingly, the comparative example is remarkably improved as compared with the conventional example with no magnetic field. The reason for this is that the variation in the molten pool surface is suppressed by the applied static magnetic field in the present invention and the comparative example.

Further, in the present invention, the discharge flow is not only decelerated but also diffused at the gap portion provided between the upper and lower static magnetic fields, and is made to be the uniform descending flow by the lower static magnetic field.

WORKING EXAMPLE 13

The experiments were made for comparing a case of applying the static magnetic field in the whole width range of the mold, with a case of applying the static magnetic field in a partial width range of the mold. A low carbon aluminum-killed steel containing an oxygen concentration of 20–24 ppm was continuously cast using a two-strand continuous casting machine. In both the strands, the gas for preventing the nozzle blocking was injected at an injection rate of 10N1/min.

The casting condition is as follows:

Size of mold: 200 mm in thickness 1500 mm in width 800 mm in height

Superheat of molten steel in tundish: about 30° C.

Casting speed: 2.2 m/min

Figure 17B:
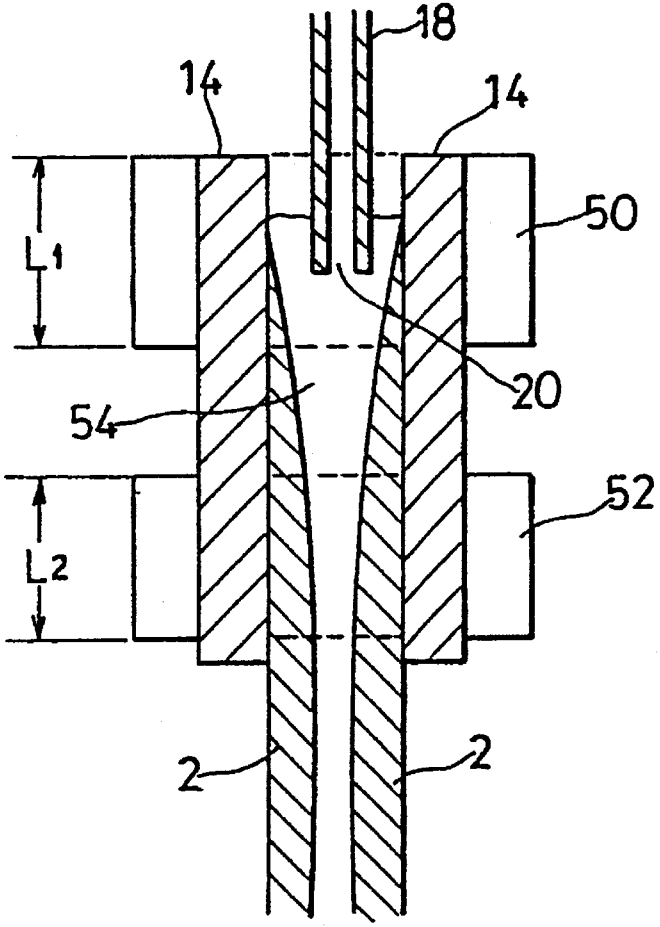
FIGS. 17(*a*) and 17(*b*) are sectional views of a continuous casting apparatus including a two-stage (upper and lower) static magnetic field generator provided partially in the width direction.
Figure 17A:
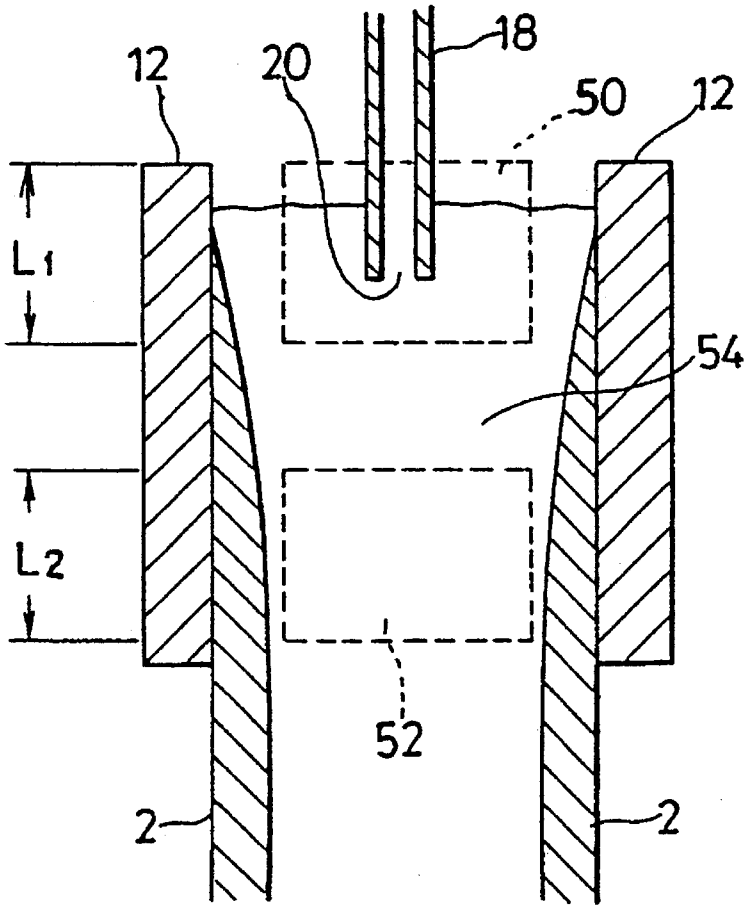

FIG. 17 shows the two-stage static magnetic field generator for partially applying the static magnetic field. The specification of the static magnetic field generator is as follows:

Upper static magnetic field generator:

Size: 800 mm in width, 300 mm ($L_1$) in height

Maximum magnetic flux density: 0.4T

Interval of magnetic poles: 300 mm (from lower end of upper magnetic field generator to upper end of lower static magnetic field generator)

Lower static magnetic field generator:

Size: 800 mm in width, 300 mm ($L_2$) in height

Maximum magnetic flux density: 0.4T

Figure 20:
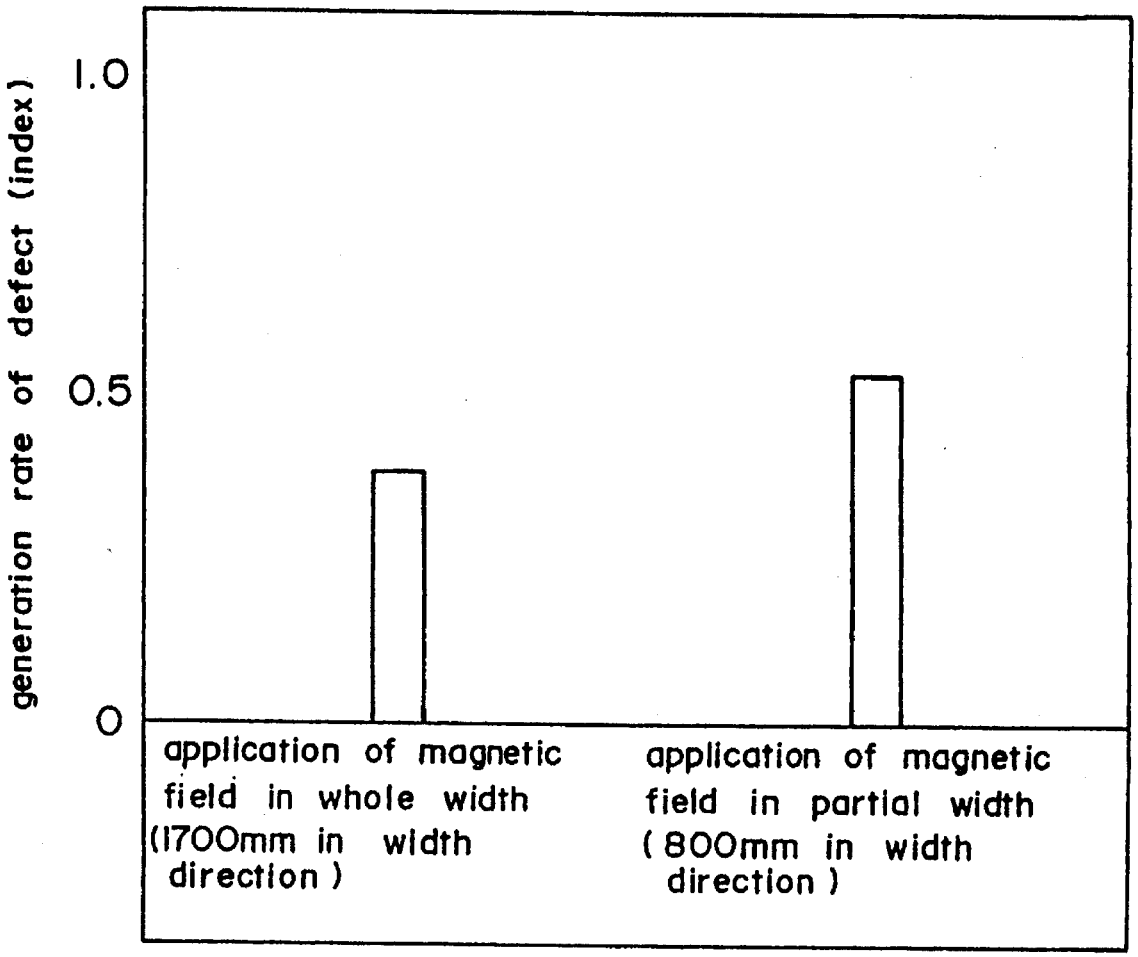
FIG. 20 is a graph for comparatively showing the generation rate (index) of the defects in the cases of disposing the static magnetic field generator over the whole width and of disposing the magnetic field generator in the partial width as shown in Working example 13.

The experiment was made by disposing the above two-stage static magnetic field generator at one strand. Also, for comparison, another experiment was made at the other strand under the same condition as in Working example 10. The results are shown in FIG. 20. As is apparent from FIG. 20, it is preferable to apply the static magnetic field in a width range of 1700 mm. However, even in the case of partially applying the static magnetic field, it is more preferable as compared with the conventional casting process.

WORKING EXAMPLE 14

Figure 21B:
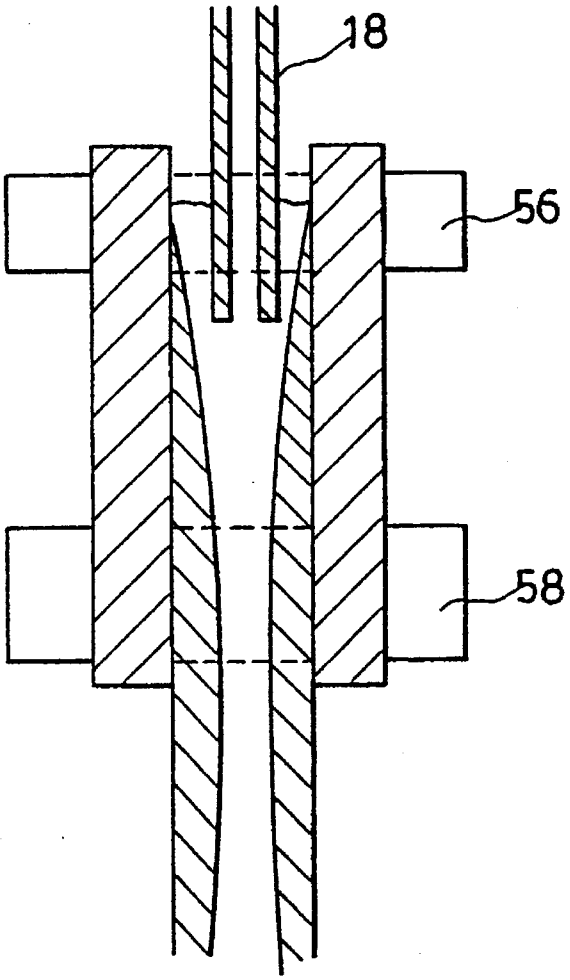
FIGS. 21(*a*) and 21(*b*) are sectional views showing the construction of the continuous casting apparatus according to Working example 14.
Figure 21A:
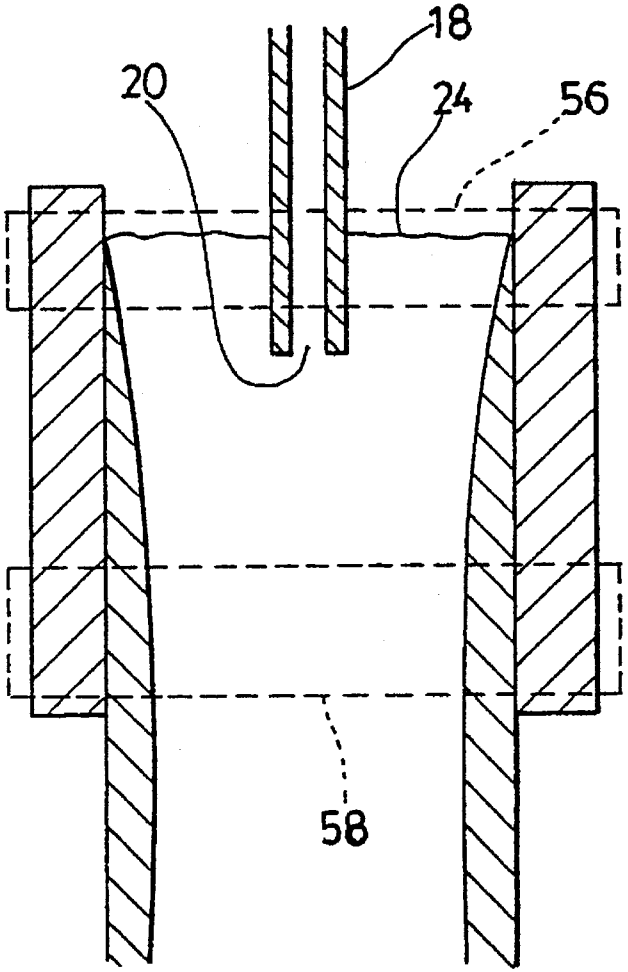

The continuous casting was performed using a continuous casting apparatus as shown in FIGS. 21(*a*) and 21(*b*). By use of a straight immersion nozzle 18 having a straight discharge port 20 being opened at the leading edge of the nozzle main body, the continuous casting was made by restricting the molten steel supplied into a continuous casting mold 10 from the nozzle in the magnetic pole range of a static magnetic field generator 58 disposed on the lower portion of the continuous casting mold 10 (see FIGS. 21(*a*) and 21(*b*)).

As a result, there is eliminated the inconvenience of the nozzle blocking caused by the alumina deposition, and accordingly, even when the molten steel is poured in the mold at the desired speed, the inclusions doe not permeate in the deep portion of the molten steel. Also, even when the flow of the molten steel in the meniscus direction by the restricting effect, the flow of the molten steel is restricted by the static magnetic field from the static magnetic field generator 56 disposed at the position corresponding to the meniscus portion, which makes it possible to prevent the entrapment of the mold powder on the bath surface.

WORKING EXAMPLE 15

By use of a two-strand continuous casting machine, the molten steel adjusted by ladle refining and containing a C concentration of 400–550 ppm, an Al concentration of 400–570 ppm, and an oxygen concentration or 23–29 ppm was continuously cast by three charges (285t/charge) under the condition described later. After the casting, the alumina depositing states within the straight immersion nozzles were examined. As shown in FIG. 21, a lower static magnetic field generator 58 was disposed in such a manner that the upper end thereof was held at the position lower than the lowermost end portion of the immersion nozzle by 100 mm, and the lower end thereof was held at the position lower than the lowermost end portion of the discharge port by 600 mm. An upper static magnetic field generator 56 was disposed in such a manner that the upper end thereof was held at the position higher than a molten steel meniscus 24 by 100 mm, and the lower end thereof was held at the position lower than the meniscus 24 by 200 mm. At one strand, the conventional two-hole type immersion nozzle was used. At the other strand, the straight immersion nozzle 18 was used and the static magnetic field generators 56 and 58 were disposed.

The casting condition is as follows:

Size of mold: 240 mm (short side wall)

1600 mm (long side wall)

Casting speed: 1. 65 m/min

Superheat of molten steel in tundish: about 25°–30° C.

The specification of the static magnetic field generator is as follows:

Upper static magnetic field generator:

Size: 1700 mm in width, 300 mm in length

Maximum magnetic flux: about 3150 gauss

Lower static magnetic field generator:

Size: 1700 mm in width, 500 mm in length

Maximum magnetic flux: about 3150 gauss

In the continuous casting using the conventional two-hole type immersion nozzle to which the gas for preventing the nozzle blocking was injected at an injection rate of 10N1/min, there was recognized an alumina depositing layer having a thickness of 10 mm at maximum in the vicinity of the nozzle discharge port. On the contrary, in the continuous casting using the straight immersion nozzle with the static magnetic field, in despite of no injection of Ar gas in the nozzle, it was revealed that the alumina depositing layer was generated within the nozzle to a thickness of about 2 mm at maximum, and accordingly, the nozzle blocking was extremely small.

The molten steel containing an oxygen concentration of 12–16 ppm was obtained by ladle refining, wherein Al power was added within the ladle on the slag on the bath surface of the molten steel having the same composition as in Working example 14 for reducing the FeO in the slag on the molten steel in the ladle to be 2.3% or less in concentration. The above molten steel was continuously cast by three charges (285t/charge) under the same condition as in Working example 14. Thus, the alumina depositing states within the immersion nozzles were examined. In this working example, for both strands, the gas for preventing the nozzle blocking was not injected in the immersion nozzles.

As a result, in the conventional casting using the two-hole immersion nozzle, the nozzle blocking was generated at the third charge, so that the specified injection rate was not achieved and thus the casting speed was reduced from 1.65 m/min to 1.0 m/min. On the other hand, in the continuous casting using the straight immersion nozzle with the static magnetic field, the casting speed was not reduced. After the casting, the inner surface of the recovered straight immersion nozzle was observed, which gave the result that the alumina was deposited thereon only to a thickness of about 1–2 mm.

In addition, the experiment using the straight immersion nozzle without the static magnetic field, and the experiment using only lower static magnetic field generator were made separately. In the former experiment, the jet of the high temperature molten steel discharged from the leading edge of the nozzle was made to strongly flow downwardly in the vertical direction to wash the solidified shell, thereby obstructing the progress of solidification of the portion. Thus, the so-called breakout was generated, and thereby the casting was made impossible. Also, in the latter experiment, the variation in the molten pool surface becomes larger thereby making impossible the stable casting. Further, as a result of observation for the surface of the cold-rolled steel plate obtained by rolling the slab cast in the latter experiment, there was recognized the lot of entrapment of the mold powder. On the contrary, in Working examples 14 and 15, as described above, the stable casting was possible by the application of the upper and lower static magnetic fields.

The continuous casting slabs obtained in Working examples 14 and 15 were hot-rolled and cold-rolled to a thickness of 1.0 mm. The cold-rolled steel plates thus obtained were examined for the generation rate of the surface defects (total of blistering defects and sliver defects). The results are shown in FIG. 22.

Figure 22:
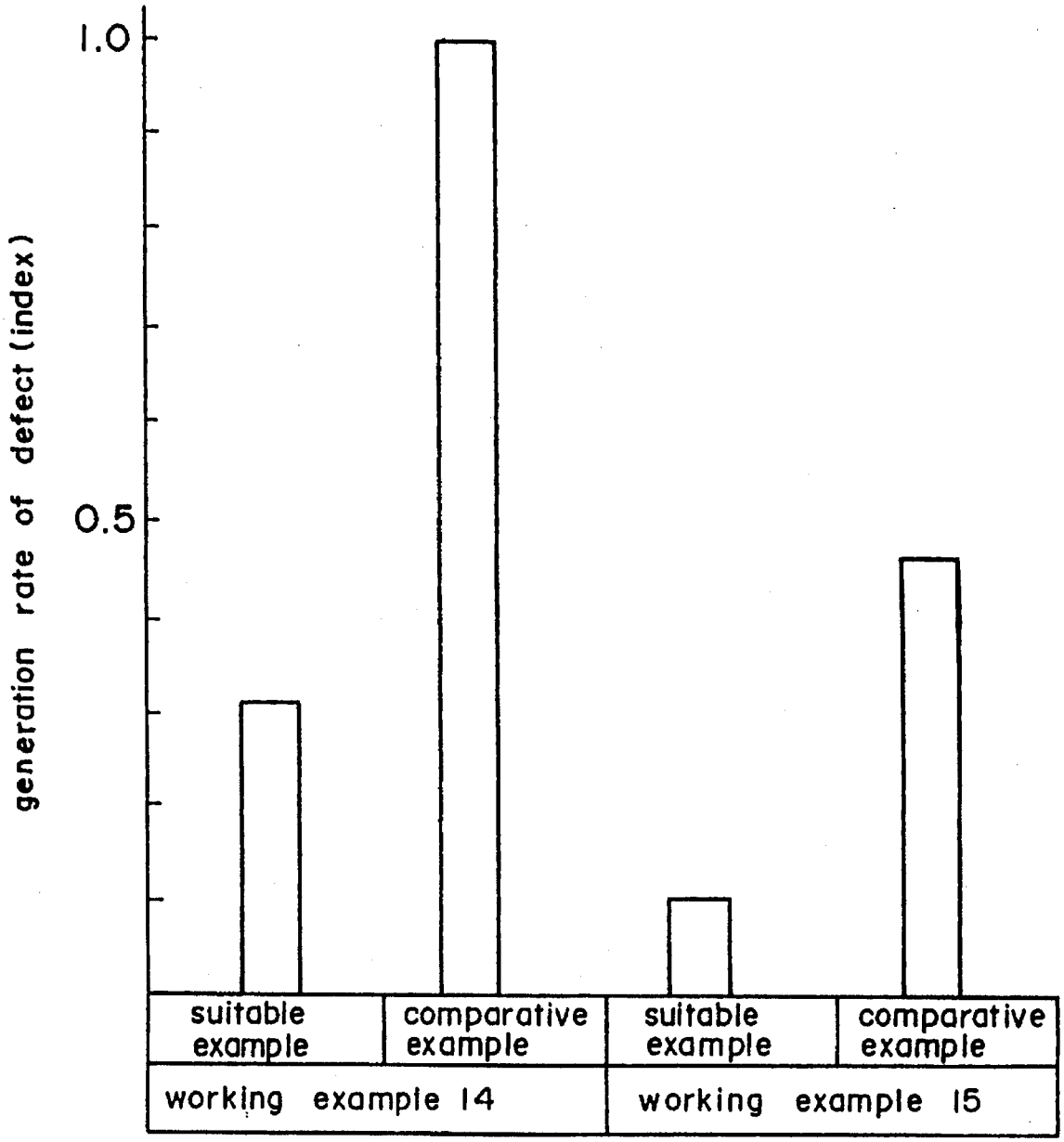
FIG. 22 is a bar graph for comparatively showing the results of Working examples 14 and 15 in terms of the generation rate of (index) of the surface defects.

As is apparent from FIG. 22, it is revealed that the generation rate of the surface defects is extremely small in the continuous casting using the straight immersion nozzle with the static magnetic field. The reason for this is as follows: namely, by the application of the static magnetic field to the continuous casting mold, the pouring flow of the molten steel is prevented from permeating to the deep portion of the crater; and the flow of the molten steel at the meniscus portion is restricted thereby eliminating the entrapment of the mold powder. Also, the reason why the result obtained from the suitable example in Working example 15 is more preferable than that in Working example 14 is considered as follows: namely, the oxygen concentration in the molten steel is low and the Ar gas injection as a main cause of generating the blistering defects is not performed. In addition, even in the comparative example in Working example 15, the fairly preferable result is obtained; however, since the gas for preventing the nozzle blocking is not injected in the nozzle, the nozzle blocking is generated, thereby making it impossible to obtain the desired casting speed, which brings about the problem in productivity.

WORKING EXAMPLE 16

FIG. 23 is a view for explaining the construction of this working example. Directly under a mold 10, there are provided static magnetic field generating coils 60 for generating a static magnetic field in the direction perpendicular to the long side surface of the casting, and exciting rolls 62 for applying a direct current in the direction perpendicular to the short side surface of the casting. The static magnetic field generated at the static magnetic field generating coil 60 is applied to a widthwise central portion of the casting 2 from a suitable point under the discharge port 20 of the immersion nozzle, for example, at the position directly under the mold 10. In FIG. 23, the directions of the magnetic field B, the current I, and the electromagnetic force F in the molten steel are shown in a chain line, a dashed line, and two-dot chain line, respectively.

In addition, in the above construction as shown in FIG. 23, there are shown the static magnetic field generating coils 60 and the exciting rolls 62 set in one-stage in the casting direction under the level of the immersion nozzle discharge port 20; however, the same constructions may be set in two or more stages in the casting direction.

In this experimental example, by applying the static magnetic field to only the position near the widthwise central portion of the casting under the immersion nozzle discharge port 20, it is possible to effectively reduce the descending flow rate within the casting, and hence to prevent the permeation of the inclusions and babbles.

In the continuous casting using the straight immersion nozzle 18 with the static magnetic field excitation, the discharge flow of the molten steel from the nozzle is usually made to the uniform descending flow, so that the above static magnetic field excitation may be applied only in the vicinity of the widthwise central portion of the casting 2 at the position under the immersion nozzle discharge port 20, to thus restrict the flow of the molten steel.

Extremely low carbon aluminum-killed steel (C=10–20 ppm), which was obtained by RH treatment after blowing in a converter, was continuously cast by six strands (285t/strand) at a throughput of 6.0t/(min·strand) under the following condition.

Size of slab: 215 mm (t)×1500 mm (W)

Type of continuous casting machine: vertical bending continuous casting machine, two strand, vertical portion (2 m)

Superheat of molten steel in tundish: 15°–20° C.

Immersion depth of nozzle: 250 mm (distance between meniscus and nozzle jetting port)

Oxygen concentration of molten steel in tundish: 12–15 ppm

Length of mold: 900 mm

Distance between meniscus and lower end of mold: 800 mm

Slabs were continuously cast according to respective casting processes described later, and then hot-rolled and cold-rolled to a thickness of 0.7 mm. The cold-rolled steel plates thus obtained were examined in an inspecting line, and were compared with each other in the generation rate of sliver and blistering defects caused by steel-making. As a result, according to the present invention, it is possible to extremely reduce the generation rate of defects as compared with the conventional casting.

COMPARATIVE EXAMPLE 16-1

Immersion nozzle: two-hole nozzle, no static magnetic field

Flow rate of Ar gas injected in immersion nozzle: 15N1/min

Generation rate of internal and surface defects of cold-rolled steel plate: 3.6%

COMPARATIVE EXAMPLE 16-2

Immersion nozzle: two-hole nozzle

Intensity of static magnetic field: 0.35T

Flow rate of Ar gas injected in immersion nozzle: 15N1/min

Generation rate of internal and surface defects of cold-rolled steel plate: 2.8%

WORKING EXAMPLE 16-1

Immersion nozzle: single straight nozzle discharge port (80 mmϕ)

Setting position of static magnetic field: one piece, being set at position apart from meniscus by 900–1050 mm to apply static magnetic field to widthwise central portion of casting Intensity of static magnetic field: 0.35T Applied current: 3500A (DC)

Injection of gas into immersion nozzle: not performed

Generation rate of internal and surface defects of cold-rolled steel plate: 0.3%

WORKING EXAMPLE 17

Figure 24A:
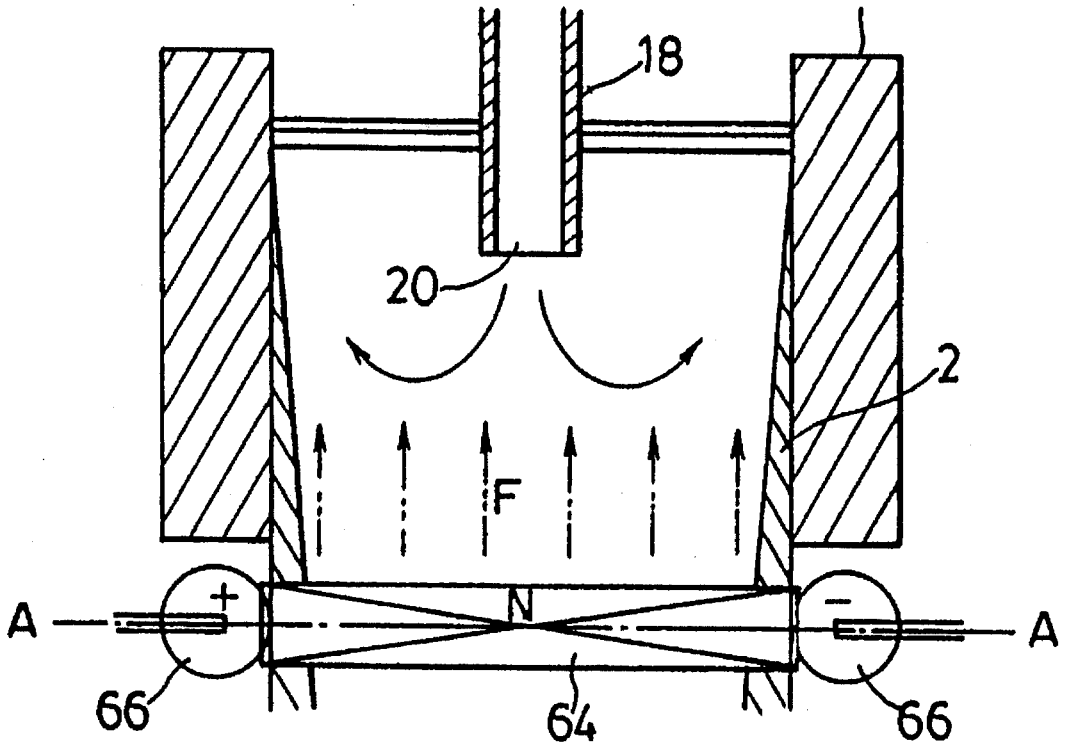
FIGS. 24(*a*) and 24(*b*) are explanatory views of Working example 17.
Figure 24B:
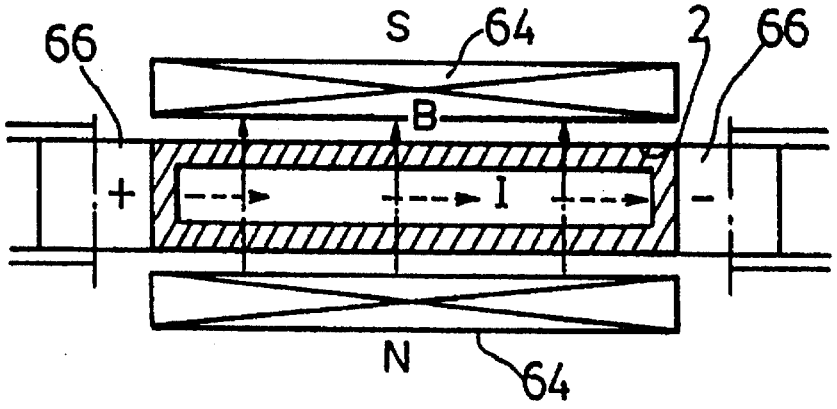

FIG. 24 is a view for explaining the construction of this working example 17. Directly under a mold 10, there are provided static magnetic field generating coils 64 for generating a static magnetic field in the direction perpendicular to the long side surface of the casting, and exciting rolls 66 for applying a direct current in the direction perpendicular to the short side surface of the casting. The static magnetic field generated at the static magnetic field generating coils 60 is applied to the whole width of the casting 2 from a suitable point under the discharge port 20 of the immersion nozzle, for example, at the position directly under the mold 10. In FIG. 24, the directions of the magnetic field B, the current I, and the electromagnetic force F in the molten steel are shown in a chain line, a dashed line, and two-dot chain line, respectively.

Extremely low carbon aluminum-killed steel (C=15–25 ppm), which was obtained by RH treatment after blowing in a converter, was continuously cast by six strands (280t/strand) at a throughput of 5.5t/(min·strand) under the following condition.

Size of slab: 220 mm (t)×1500 mm(W)

Type of continuous casting machine: vertical bending continuous casting machine, two strands, vertical portion (3 m)

Superheat of molten steel in tundish=15°–25° C.

Immersion depth of nozzle: 300 mm (distance between meniscus and nozzle jetting port)

Oxygen concentration of molten steel in tundish: 13–18 ppm

Length of mold: 900 mm

Distance between meniscus and lower end of mold: 800 mm

Slabs were continuously cast according to respective casting processes described later, and then hot-rolled and cold-rolled to a thickness of 0.8 mm. The cold-rolled steel plates thus obtained were examined in an inspecting line, and were compared with each other in the generation rate of sliver and blistering defects caused by steel-making. As a result, according to the present invention, it is possible to extremely reduce the generation rate of defects as compared with the conventional casting.

COMPARATIVE EXAMPLE 17-1

Immersion nozzle: two-hole nozzle

Flow rate of Ar gas injected in immersion nozzle: 15N1/min

Generation rate of internal and surface defects of cold-rolled steel plate: 2.1%

COMPARATIVE EXAMPLE 17-2

Immersion nozzle: two-hole nozzle

Intensity of static magnetic field: 0.3T

Flow rate of Ar gas injected in immersion nozzle: 15N1/min

Generation rate of internal and surface defects of cold-rolled steel plate: 1.6%

EXPERIMENTAL EXAMPLE 17-1

Immersion nozzle: single straight nozzle, discharged port (80 mmϕ)

Set-up position of static magnetic field: apart from meniscus by 900–1000 mm

Figure 25:
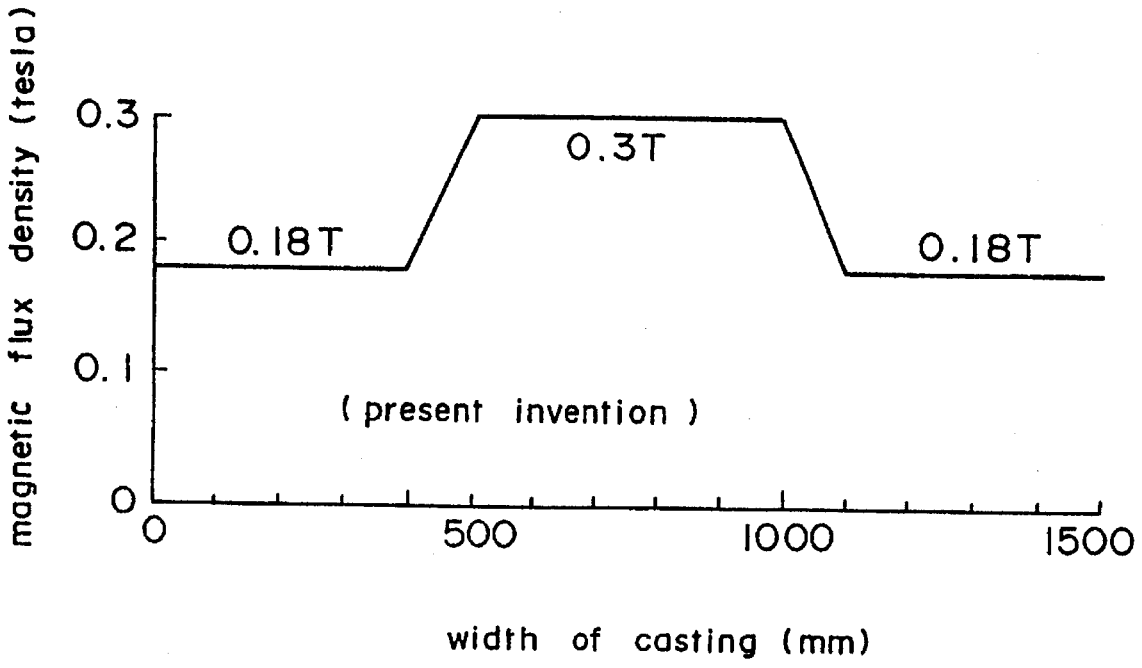
FIG. 25 is a view showing the magnetic flux density distribution in the width direction of the casting in Working example 17.

Maximum intensity of static magnetic field: 0.3T, applying to whole width of casting, widthwise distribution of magnetic flux density; as shown in FIG. 25

Applied Current: 3000A (DC)

Generation rate of internal and surface defects of cold-rolled steel plate: 0.2%

WORKING EXAMPLE 18

Figure 26A:
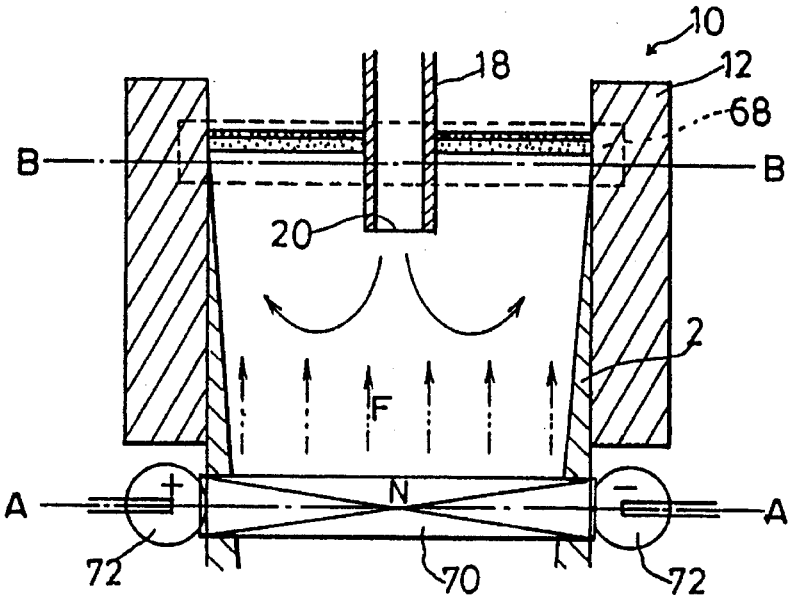
FIGS. 26(*a*), 26(*b*) and 26(*c*) are explanatory views of Working example 18.
Figure 26B:
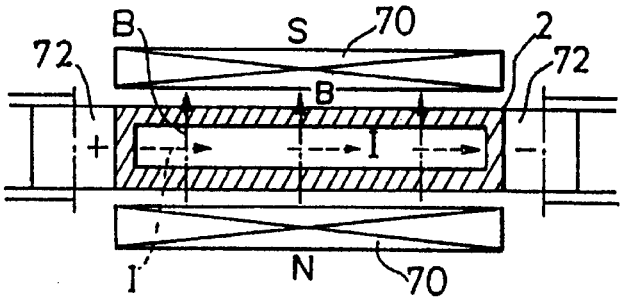
Figure 26C:
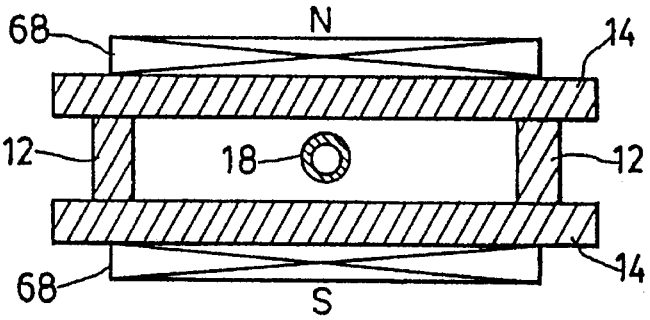

FIG. 26 is a view for explaining the construction of this working example. A static magnetic generator 68 is disposed to a mold 10 at the position corresponding to the meniscus. Further, directly under the mold 10, there are provided static magnetic field generating coils 70 for generating a static magnetic field in the direction perpendicular to the long side surface of the casting, and exciting rolls 72 for applying a direct current in the direction perpendicular to the short side surface of the casting. The static magnetic field generated at the static magnetic field generating coil 70 is applied to the whole width of the casting 2 from a suitable point under the discharge port 20 of the immersion nozzle, for example, at the position directly under the mold 10. In FIG. 26, the directions of the magnetic field B, the current I, and the electromagnetic force F in the molten steel are shown in a chain line, a dashed line, and two-dot chain line, respectively.

Extremely low carbon aluminum-killed steel (C=15–25 ppm), which was obtained by RH treatment after blowing in a converter, was continuously cast by six strands (280t/strand) at a throughput of 5.2t/(min·strand) under the following condition.

Experimental condition

Size of slab: 230 mm (t)×1500 mm (W)

Type of continuous casting machine: vertical bending continuous casting machine, two strands, vertical portion (3 m)

Superheat of molten steel in tundish: 15°–25° C.

Immersion depth of nozzle: 300 mm (distance between meniscus and nozzle jetting port)

Oxygen concentration of molten steel in tundish: 12–15 ppm

Length of mold: 900 mm

Distance between meniscus and lower end of mold: 800 mm

Slabs were continuously cast according to respective casting processes described later, and then hot-rolled and cold-rolled to a thickness of 0.4 mm. The cold-rolled steel plates thus obtained were examined in an inspecting line, and were compared with each other in the generation rate of sliver and blistering defects caused by steel-making. As a result, according to the present invention, it is possible to extremely reduce the generation rate of defects as compared with the conventional casting.

COMPARATIVE EXAMPLE 18-1

Immersion nozzle: two-hole nozzle, 75 mmϕ×2, horizontal nozzle

Flow rate of Ar gas injected in immersion nozzle: 15N1/min

Generation rate of internal and surface defects of cold-rolled steel plate: 3.5%

COMPARATIVE EXAMPLE 18-2

Immersion nozzle: two-hole nozzle, 75 mmϕ×2, horizontal nozzle

Intensity of static magnetic field: 0.3T, application of static magnetic field to only meniscus portion Flow rate of Ar gas injected in immersion nozzle: 15N1/min Generation rate of internal and surface defects of cold-rolled steel plate: 2.8%

WORKING EXAMPLE 18-1

Immersion nozzle: single straight nozzle, discharged port (85 mmϕ)

Static magnetic field:

Meniscus portion: 0.2T, whole width of long side of casting, widthwise distribution of magnetic flux density: uniform Position apart from meniscus by 900–1000 mm, maximum intensity of static magnetic field: 0.3T, application to whole width of casting Applied current: 2500A (DC)

Generation rate of internal and surface defects of cold-rolled steel plate: 0.1%

WORKING EXAMPLE 18-2

Immersion nozzle: single straight nozzle, discharged port (85 mmϕ)

Static magnetic field:

Meniscus portion: not applied

Figure 27:
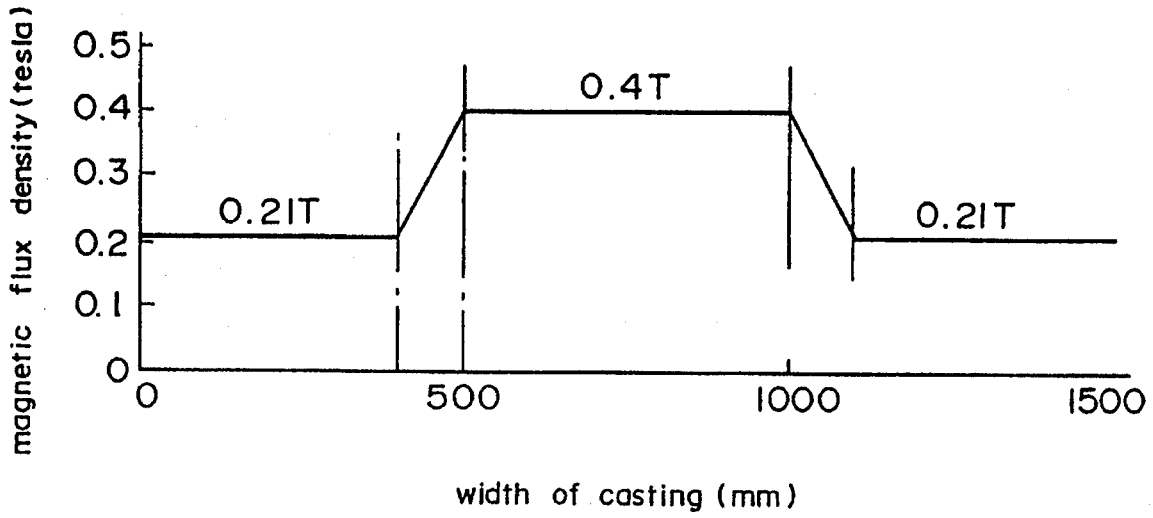
FIG. 27 is a view showing the magnetic flux density distribution in the width direction of the casting in Working example 18

Position apart from meniscus by 900–1000 mm: maximum intensity of static magnetic field: 0.4T, application to whole width of casting, widthwise distribution of magnetic flux density; as shown in FIG. 27

Applied current: 2500A (DC)

Generation rate of internal and surface defects of cold-rolled steel plate: 0.6%

WORKING EXAMPLE 19

Figure 28A:
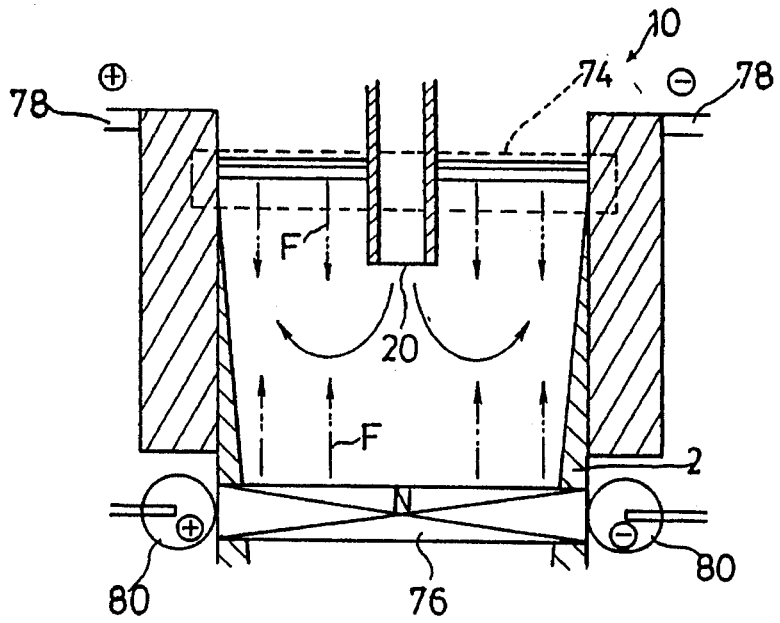
FIGS. 28(*a*), 28(*b*) and 28(*c*) are schematic views of Working example 19.
Figure 28B:
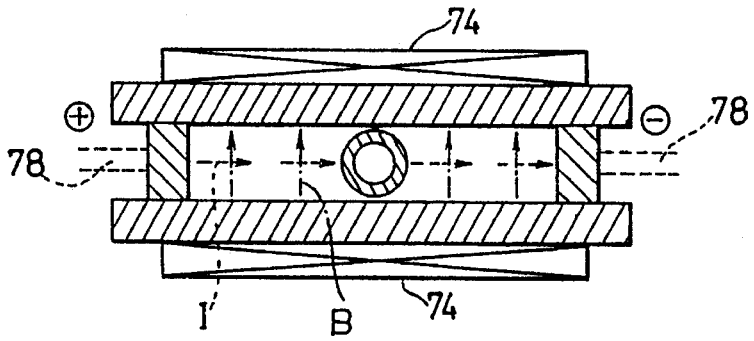
Figure 28C:
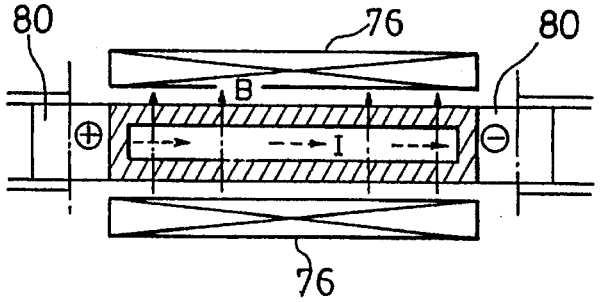

FIG. 28 is a view for explaining the construction of this working example 19. A static magnetic generator 74 is disposed to a mold 10 at the position corresponding to the meniscus. Further, directly under the mold 10, there are provided static magnetic field generating coils 76 for generating a static magnetic field in the direction perpendicular to the long side surface of the casting, and exciting rolls 80 for applying a direct current in the direction perpendicular to the short side surface of the casting. The static magnetic field generated at the static magnetic field generating coils 70 is applied to the whole width of the casting 2 from a suitable point under the discharge port 20 of the immersion nozzle, for example, at the position directly under the mold 10. In FIG. 28, the directions of the magnetic field B, the current I, and the electromagnetic force F in the molten steel are shown in a chain line, a dashed line, and two-dot chain line, respectively.

Extremely low carbon aluminum-killed steel (C=15–25 ppm), which was obtained by RH treatment after blowing in a converter, was continuously cast by seven strands (310t/strand) at a throughput of 5.8t/(min·strand) under the following condition.

Experimental condition

Size of slab: 215 mm(t)×1500 mm(W)

Type of continuous casting machine: vertical bending continuous casting machine, two strands, vertical portion (2*m*)

Superheat of molten steel in tundish: 18°–27° C.

Immersion depth of nozzle: 300 mm (distance between meniscus and nozzle jetting port)

Oxygen concentration of molten steel in tundish: 14–20 ppm

Length of mold: 900 mm

Distance between meniscus and lower end of mold: 800 mm

Slabs were continuously east according to respective casting processes described later, and then hot-rolled and cold-rolled to a thickness of 0.35 mm. The cold-rolled steel plates thus obtained were examined in an inspecting line, and were compared with each other in the generation rate of sliver and blistering defects caused by steel-making. As a result, according to the present invention, it is possible to extremely reduce the generation rate of defects as compared with the conventional casting.

COMPARATIVE EXAMPLE 19-1

Immersion nozzle: two-hole nozzle, 80 mm ϕ×2, horizontal nozzle

Flow rate of Ar gas injected in immersion nozzle: 15N1/min

Generation rate of internal and surface defects of cold-rolled steel plate: 4.5%

WORKING EXAMPLE 19-1

Immersion nozzle: two-hole nozzle, discharge port (90 mmϕ×2)

Excitation of static magnetic field:

Meniscus portion: application of electromagnetic force downwardly of casting direction Static magnetic field: 0.15T, whole width of long side of casting Applied current: 1200A (DC)

Portion Directly under mold: application of electromagnetic force upwardly of casting direction Position apart from meniscus by 900–1000 mm:

Intensity of static magnetic field: 0.3T, application to whole width of casting

Applied current: 2800A (DC)

Generation rate of internal and surface defects of cold-rolled steel plate: 0.08%

WORKING EXAMPLE 19-2

The experiment was made in the same manner as in Working example 19-1, except that the excitation of the static magnetic field was not applied to the meniscus portion.

Generation rate of internal and surface defects of cold-rolled steel plate: 1.8%

WORKING EXAMPLE 20

FIGS. 29 (*a*) and 29(*b*) show the construction of a main portion of a continuous casting apparatus used in this working example. A static magnetic generator 82 is disposed on the back surface of long side wall 14 of a continuous casting mold 10, and exciting terminals 84 are provided for applying a direct current in the direction perpendicular to the short side surface of the casting. In FIG. 29, the directions of the magnetic field B, the current I, and the electromagnetic force F in the molten steel are shown in a chain line, a dashed line, and two-dot chain line, respectively.

With this construction, according to the present invention, the static magnetic field generator 82 generates the static magnetic field in the direction perpendicular to the long side surface of the casting in the molten steel within the mold, and simultaneously the exciting terminals 84 apply the direct current in the direction perpendicular to the short side surface of the casting, which makes it possible to form the electromagnetic force upwardly of the casting direction. Therefore, it is possible to disperse the flow of the downward flow from the nozzle, and hence to suppress the permeation of the inclusions and babbles in the casting.

Extremely low carbon aluminum-killed steel (C=15–20 ppm), which was obtained by RH treatment after blowing in a converter, was continuously cast by four strands (350t/strand) at a throughput of 4.5t/(min·strand) under the following condition.

Experimental condition

Size of slab: 240 mm (t)×1500 mm (W)

Type of continuous casting machine: vertical bending continuous casting machine, vertical portion (2.5 m)

Superheat of molten steel in tundish: 15°–25° C.

Immersion depth of nozzle: 300 mm

Total oxygen amount in molten steel: 22–30 ppm

Injected amount of Ar gas: 5.0 N1/min

Conventional example: two-hole nozzle; static magnetic field, not applied

Present invention: using straight nozzle

Excitation of static magnetic field: application of electromagnetic force upwardly of casting direction Intensity of static magnetic field: 0.15T Applied current: 1100A The slabs thus continuously cast were hot-rolled and cold-rolled to a thickness of 0.7 mm. The cold-rolled steel plates thus obtained were subjected to continuous annealing, and then examined in an inspecting line, to be thus compared with each other in the generation rate of the oliver and blistering defects caused by steel-making. The generation rate of defects is represented by an equation of (weight of defective products)/(weight of inspected products)

Conventional example

Sliver: 0.02%
Blistering: 0.15%
Working example
Sliver: 0.03%
Blistering: 0.03%

In the sliver defects caused on the surface of the continuous casting by mold powder and alumina cluster, there is no difference between the conventional example and the working example. However, the generation rate of blistering defects in the working example is reduced to be ⅕ as much as that in the conventional example. Accordingly, it becomes apparent that the working example is effective to suppress the permeation of Ar gas injected from the nozzle and the inclusions within the casting.

Also, the casting test was made using the straight nozzle without excitation of the static magnetic field, separately. However, in this casting condition, the jet of the high temperature molten steel discharged from the leading edge of the nozzle was made to strongly flow in the vertical direction, and to wash the solidified shell, thereby generating the breakout, which makes impossible the casting.

WORKING EXAMPLE 21

Figure 30A:
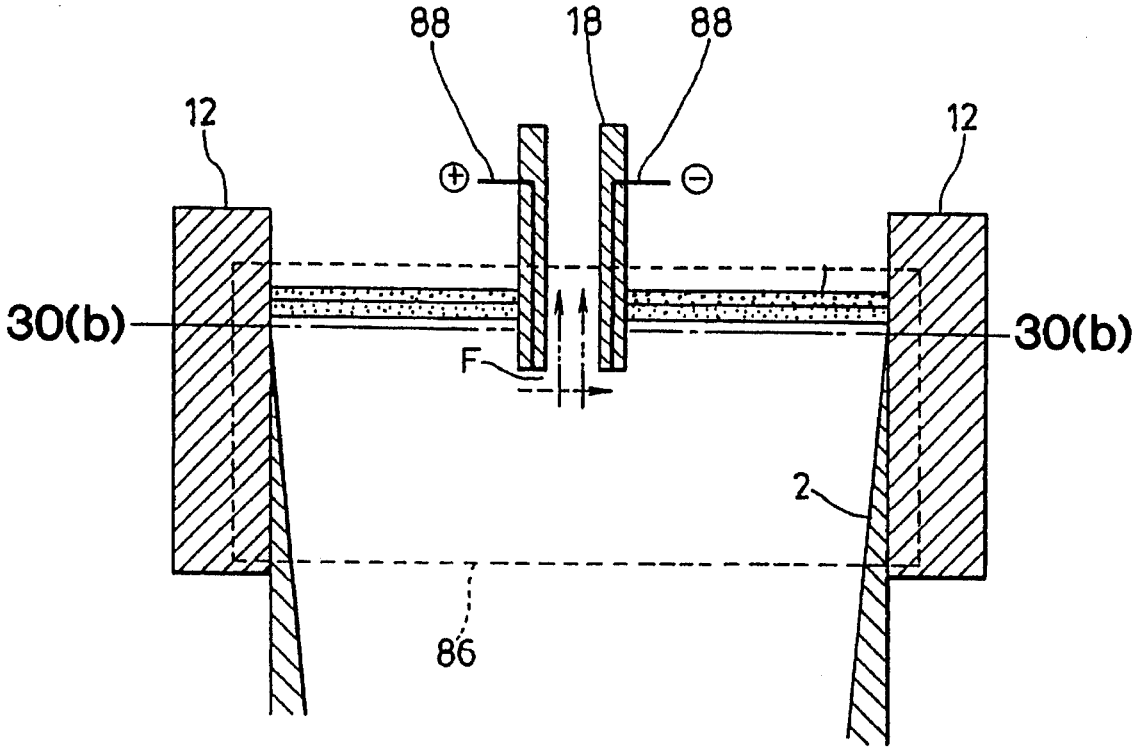
FIGS. 30(*a*) and 30(*b*) are explanatory views of Working example 21.
Figure 30B:
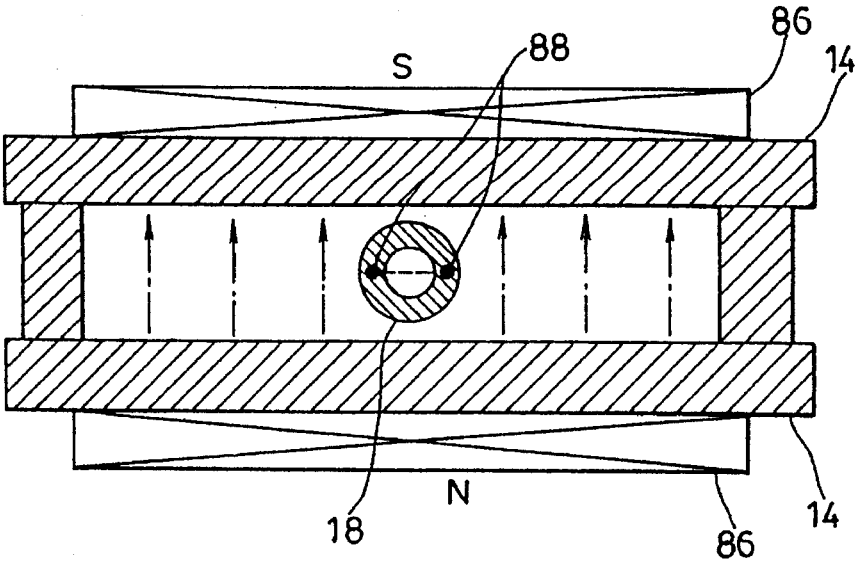

FIGS. 30 (*a*) and 29(*b*) show the construction of a main portion of a continuous casting apparatus used in this working example. A static magnetic generator 86 is disposed on the back surface of a long side wall 14 of a continuous casting mold 10. Also, exciting terminals 88 are embedded in refractories of the straight immersion nozzle 18 for applying a direct current in the direction perpendicular to the short side surface of the casting, thereby giving an electromagnetic force to the molten steel in the direction of decelerating the flow of the molten steel. In FIG. 30, the directions of the magnetic field B, the current I, and the electromagnetic force F in the molten steel are shown in a chain line, a dashed line, and two-dot chain line, respectively.

With this construction, according to the present invention, the static magnetic field generator 82 generates the static magnetic field in the direction perpendicular to the long side surface of the casting in the molten steel within the mold, and simultaneously the exciting terminals 84 apply the direct current in the vicinity of the nozzle discharge port in the direction perpendicular to the short side surface of the casting, which makes it possible to form the electromagnetic force upwardly of the casting direction. Therefore, it is possible to restrict and disperse the flow of the downward flow from the nozzle, and hence to suppress the permeation of the inclusions and babbles in the casting.

Extremely low carbon aluminum-killed steel (C=15–20 ppm) which was obtained by RH treatment after blowing in a converter, was continuously cast by four strands (350t/strand) at a throughput of 4.5t/(min·strand) under the following condition.

Experimental condition

Size of slab: 240 mm in thickness×1500 mm in width

Type of continuous casting machine: vertical bending continuous casting machine, vertical portion (2.5 m)

Superheat of molten steel in tundish: 15°–25° C.

Immersion depth of nozzle: 300 mm

Total oxygen amount in molten steel: 25–30 ppm

Conventional example: two-hole nozzle; static magnetic field, not applied

Working example: straight nozzle

Intensity of static magnetic field: 0.15T

Applied current: 1100A

Excitation of static magnetic field: application of electromagnetic force upwardly of casting direction The slabs thus continuously cast were hot-rolled and cold-rolled to a thickness of 0.7 mm. The cold-rolled steel plates thus obtained were subjected to continuous annealing, and then examined in an inspecting line, to be thus compared with each other in the generation rate of the sliver defects and blistering defects caused by steel-making. The generation rate of defects is represented by an equation of (weight of defective products)/(weight of inspected products)

Conventional example

Sliver: 0.02%

Blistering: 0.16%

Working example

Sliver: 0.03%

Blistering: 0.03%

In the sliver defect caused on the surface of the continuous casting by mold power and alumina cluster, there is no difference between the conventional example and the working example. However, the generation rate of blistering defects in the working example is reduced to be ⅕ as much as that in the conventional example. Accordingly, it becomes apparent that the working example is effective to suppress the permeation of Ar gas injected from the nozzle and the inclusions within the casting.

Also, the casting test was made using the a straight immersion nozzle without the excitation of the static magnetic field, separately. However, in this casting condition, the jet of the high temperature molten steel discharged from the leading edge of the nozzle was made to strongly flow in the vertical direction, and to wash the solidified shell, thereby generating the breakout, which makes impossible the casting.

WORKING EXAMPLE 22

The steel of the same kind as in Working example and containing a total oxygen amount of 20 ppm or less was continuous cast under the same condition as in Working example 21 except that Ar gas was not injected in the immersion nozzle. The cold-rolled steel plates thus obtained were examined. In the steel plates continuously cast according to the present invention, rolled and annealed, there was obtained the preferable results of sliver defects (0.01%) and blistering defects (0%). On the contrary, in the conventional casting without gas injection, the desired pouring speed was not achieved at third charge because of the nozzle blocking, and the casting speed was reduced from 1.6 m/min to 1.2 m/min. Needless to say, in the casting of the present invention, the casting speed was not reduced, and only the alumina depositing layer of 1–2 mm and a slight blocking were recognized on the inner surface of the straight nozzle after casting.

We claim:

1. A process for continuously casting steel comprising the steps of:

supplying a direct flow of molten steel at a pouring speed of at least 1.5 tons/minute from a tundish to a continuous casting mold through a straight immersion nozzle which has a single discharge port, while blowing an inert gas therethrough for preventing said nozzle from clogging, said casting mold comprised of a pair of spaced long side walls interconnected to a pair of short side walls, a mold top, and a mold bottom, wherein a vertical height between said mold top and bottom defines a magnetic field operating range, said mold long side walls each having a front surface and a back surface, an upper side and a lower side, said immersion nozzle having a tube configuration with an upper and lower end, said lower end defining said discharge port;

disposing a respective static magnetic generator on the back surfaces of the long side walls of said mold at a vertical region which includes the lower end defining the discharge port of said straight immersion nozzle when a magnetic field is generated; and casting said molten steel while generating a static magnetic field, said magnetic field directed from one long side wall to the other long side wall of said mold in order to control a direct flow rate of said molten steel into said mold.

2. A process for continuously casting molten steel as claimed in claim 1 in which when the static magnetic field generator applies a two-stage static magnetic field to the mold at a position lower than the level of said discharge port, said magnetic field defined by a relationship between a magnetic flux density B(T) and said magnetic field range L(mm) at various discharge flow velocities v(m/sec), said relationship being set as follows:

when $v \leqq 0.9$ (m/sec), $B \times L \geqq 16$
where $B \geqq 0.05T$, $L \geqq 50$ mm $0.9 \leqq v \leqq 1.5$ (m/sec), $B \times L \geqq 18$
where $B \geqq 0.07T$, $L \geqq 60$ mm $1.5 \leqq v \leqq 2.0$ (m/sec), $B \times L \geqq 19$
where $B \geqq 0.08T$, $L \geqq 70$ mm $2.0 \leqq v \leqq 2.5$ (m/sec), $B \times L \geqq 20$
where $B \geqq 0.09T$, $L \geqq 80$ mm $2.5 \leqq v \leqq 3.0$ (m/sec), $B \times L \geqq 21$
where $B \geqq 0.1T$, $L \geqq 90$ mm $3.0 \leqq v \leqq 4.0$ (m/sec), $B \times L \geqq 22$
where $B \geqq 0.11T$, $L \geqq 100$ mm $4.0 \leqq v \leqq 5.0$ (m/sec), $B \times L \geqq 24$
where $B \geqq 0.12T$, $L \geqq 100$ mm $5.0 \leqq v \leqq 6.0$ (m/sec), $B \times L \geqq 26$
where $B \geqq 0.13T$, $L \geqq 110$ mm.

3. A process for continuously casting molten steel as claimed in claim 2 in that an upper static magnetic field is applied over said entire width of said mold.

4. A process for continuously casting molten steel as claimed in claim 2 in that a lower static magnetic field is applied over said entire width of said mold.

5. A process for continuously casting steel comprising the steps of:

supplying a direct flow of molten steel at a pouring speed of at least 1.5 tons/minute from a tundish to a continuous casting mold through a straight immersion nozzle which has a single discharge port, while blowing an inert gas therethrough for preventing said nozzle from clogging, said casting mold comprised of a pair of spaced long side walls interconnected to a pair of short side walls, a mold top, and a mold bottom, wherein a vertical height between said mold top and bottom defines a magnetic field operating range, said mold long side walls each having a front surface and a back surface, an upper side and a lower side, said immersion nozzle having a tube configuration with an upper and lower end, said lower end defining said discharge port;

disposing a respective static magnetic generator on the back surfaces of the long side walls of said mold at a vertical region which includes the lower end defining the discharge port of said straight immersion nozzle when a magnetic field is generated;

disposing a gap portion and further disposing at least one additional stage of static magnetic field generators on the lower side of said mold, below said gap portion; and casting said molten steel while generating a static magnetic field, said magnetic field directed from one long side wall to the other long side wall of said mold in order to control a direct flow rate of said molten steel into said mold.

6. A process for continuously casting molten steel as claimed in claim 5 in that an upper static magnetic field is applied over an entire region in a width direction of said mold.

7. A process for continuously casting molten steel as claimed in claim 5, in that a lower static magnetic field is applied over an entire region in a width direction of said mold.

8. A process for continuously casting steel comprising the steps of:

supplying a direct flow of molten steel at a pouring speed of at least 1.5 tons/minute from a tundish to a continuous casting mold through a straight immersion nozzle which has a single discharge port, while blowing an inert gas therethrough for preventing said nozzle from clogging, said casting mold comprised of a pair of spaced long side walls interconnected to a pair of short side walls, a mold top, and a mold bottom, wherein a vertical height between said mold top and bottom defines a magnetic field operating range, said mold long side walls each having a front surface and a back surface, an upper side and a lower side, said immersion nozzle having a tube configuration with an upper and lower end, said lower end defining said discharge port;

disposing a respective static magnetic generator on the back surfaces of the long side walls of said mold at a vertical region which includes the lower end defining the discharge port of said straight immersion nozzle when a magnetic field is generated;

disposing a gap portion and further disposing at least one additional stage of static magnetic field generators on the lower side of said mold, below said gap portion; and casting said molten steel while generating a static magnetic field, said magnetic field directed from one long side wall to the other long side wall of said mold in order to control a direct flow rate of said molten steel into said mold.

9. A process for continuously casting steel comprising the steps of:

supplying a direct flow of molten steel at a pouring speed of at least 1.5 tons/minute from a tundish to a continuous casting mold through a straight immersion nozzle which has a single discharge port, while blowing an inert gas therethrough for preventing said nozzle from clogging, said casting mold comprised of a pair of spaced long side walls interconnected to a pair of short side walls, a mold top, and a mold bottom, wherein a vertical region between said mold top and bottom defines a magnetic field operating range, said mold long side walls each having a front surface and a back surface and defining a width of said mold, an upper side and a lower side, said immersion nozzle having a tube configuration with an upper and lower end, said lower end defining said discharge port;

disposing a respective static magnetic generator on the back surfaces of the long side walls of said mold at a vertical region which includes the lower end of the discharge port of said straight immersion nozzle when a magnetic field is generated;

casting said molten steel while generating a static magnetic field, said magnetic field directed from one long side wall to the other long side wall of said mold in order to control a direct flow rate of said molten steel into said mold;

said magnetic field respectively defined by a relationship between a magnetic flux density B(T) and magnetic field range L(mm) at various discharge flow velocities v(m/sec), said relationship being set as follows:

when $v \leqq 0.9$ (m/sec), $B \times L \geqq 25$
where $B \geqq 0.07T$, $L \geqq 80$ mm $0.9 \leqq v \leqq 1.5$ (m/sec), $B \times L \geqq 27$
where $B \geqq 0.08T$, $L \geqq 90$ mm $1.5 \leqq v \leqq 2.0$ (m/sec), $B \times L \geqq 30$
where $B \geqq 0.09T$, $L \geqq 100$ mm $2.0 \leqq v \leqq 2.5$ (m/sec), $B \times L \geqq 33$
where $B \geqq 0.09T$, $L \geqq 110$ mm $2.5 \leqq v \leqq 3.0$ (m/sec), $B \times L \geqq 35$
where $B \geqq 0.1T$, $L \geqq 110$ mm $3.0 \leqq v \leqq 3.8$ (m/sec), $B \times L \geqq 36$
where $B \geqq 0.11T$, $L \geqq 120$ mm $3.8 \leqq v \leqq 4.8$ (m/sec), $B \times L \geqq 38$
where $B \geqq 0.12T$, $L \geqq 120$ mm $4.8 \leqq v \leqq 5.5$ (m/sec), $B \times L \geqq 40$
where $B \geqq 0.13T$, $L \geqq 130$, wherein said static magnetic field is applied over said entire width of said mold.

* * * * *